US012458123B2

(12) United States Patent
Dorsey et al.

(10) Patent No.: US 12,458,123 B2
(45) Date of Patent: Nov. 4, 2025

(54) REVERSIBLE HAIRCLIP

(71) Applicant: John E. Dorsey, Whittier, CA (US)

(72) Inventors: John E. Dorsey, Whittier, CA (US); James E. Grimes, Yorba Linda, CA (US); Rebecca G. Inducil-Ingraham, Upland, CA (US)

(73) Assignee: John E. Dorsey, Whittier, CA (US)

( * ) Notice: Subject to any disclaimer, the term of this patent is extended or adjusted under 35 U.S.C. 154(b) by 401 days.

(21) Appl. No.: 18/007,711

(22) PCT Filed: Jun. 2, 2021

(86) PCT No.: PCT/US2021/035382
§ 371 (c)(1),
(2) Date: Dec. 1, 2022

(87) PCT Pub. No.: WO2021/247657
PCT Pub. Date: Dec. 9, 2021

(65) Prior Publication Data

US 2023/0225476 A1 Jul. 20, 2023

Related U.S. Application Data

(60) Provisional application No. 63/034,318, filed on Jun. 3, 2020.

(51) Int. Cl.

| | |
|---|---|
| ***A45D 8/34*** | (2006.01) |
| ***A45D 8/28*** | (2006.01) |
| ***A45D 8/32*** | (2006.01) |

(52) U.S. Cl.
CPC ..... *A45D 8/34* (2013.01); *A45D 8/28* (2013.01); *A45D 8/32* (2013.01)

(58) Field of Classification Search
CPC ..... A45D 8/34; A45D 8/32; A45D 8/28
See application file for complete search history.

(56) References Cited

U.S. PATENT DOCUMENTS

| | | | | |
|---|---|---|---|---|
| 857,222 | A | 6/1907 | Bagley | |
| 1,371,991 | A * | 3/1921 | Duffee | A45D 8/34 132/54 |

(Continued)

FOREIGN PATENT DOCUMENTS

| | | |
|---|---|---|
| CN | 201758985 | 3/2011 |
| CN | 206714348 | 12/2017 |
| FR | 968262 | 11/1950 |

OTHER PUBLICATIONS

International Search Report and Written Opinion of PCT/US2021/035382, Dated Oct. 6, 2021 in 23 pages.

*Primary Examiner* — Nicholas D Lucchesi
(74) *Attorney, Agent, or Firm* — Knobbe, Martens, Olson & Bear, LLP

(57) ABSTRACT

Various reversible hairclips are disclosed. The reversible hairclip can include a band and a curved pin. The band can comprise a first end and a second end. The reversible hairclip can comprise a knob, a tip end, and a slot between the knob and the tip end. The tip end can comprise a plurality of notches along first and second elongate sides of the curved pin that are configured to engage with the second end of the band. The slot of the pin can be configured to receive the first end of the band such that the first end of the band is able to move within the slot. The curved pin can be configured to rotate about an axis of the first end of the band such that the second end of the band is able to engage with the plurality of notches on the pin.

18 Claims, 25 Drawing Sheets

(56) References Cited

U.S. PATENT DOCUMENTS

| | | | | | |
|---|---|---|---|---|---|
| 1,736,215 | A * | 11/1929 | Oppenheimer | A45D 8/32 | 132/279 |
| RE21,704 | E * | 2/1941 | Caldora | A45D 2/2414 | 132/249 |
| 3,081,781 | A * | 3/1963 | Stermer | A45D 8/34 | 132/273 |
| 3,751,769 | A * | 8/1973 | Reiner | A45D 8/34 | 132/273 |
| 3,841,340 | A * | 10/1974 | Solomon | A45D 8/28 | 132/279 |
| 5,154,196 | A * | 10/1992 | Moffat | A45D 8/24 | 132/278 |
| 5,365,955 | A * | 11/1994 | Desgroux | A45D 8/34 | 132/278 |
| 5,441,061 | A * | 8/1995 | Jordan | A45D 8/20 | 132/277 |
| 5,771,908 | A | 6/1998 | Dorsey | | |
| 6,386,208 | B1 * | 5/2002 | Reid | A45D 8/34 | 132/275 |
| 8,544,479 | B2 | 10/2013 | Shyu | | |
| 10,258,133 | B2 * | 4/2019 | Beck | A45D 8/26 | |
| 2008/0072922 | A1 * | 3/2008 | Shidler | A45D 8/34 | 132/275 |
| 2010/0108091 | A1 * | 5/2010 | Lay | A45D 8/28 | 132/279 |
| 2014/0224273 | A1 * | 8/2014 | Truskalo | A45D 8/34 | 132/275 |
| 2018/0084886 | A1 * | 3/2018 | O'Hare | A45D 2/20 | |
| 2022/0079268 | A1 * | 3/2022 | Pires | A41D 15/04 | |

* cited by examiner

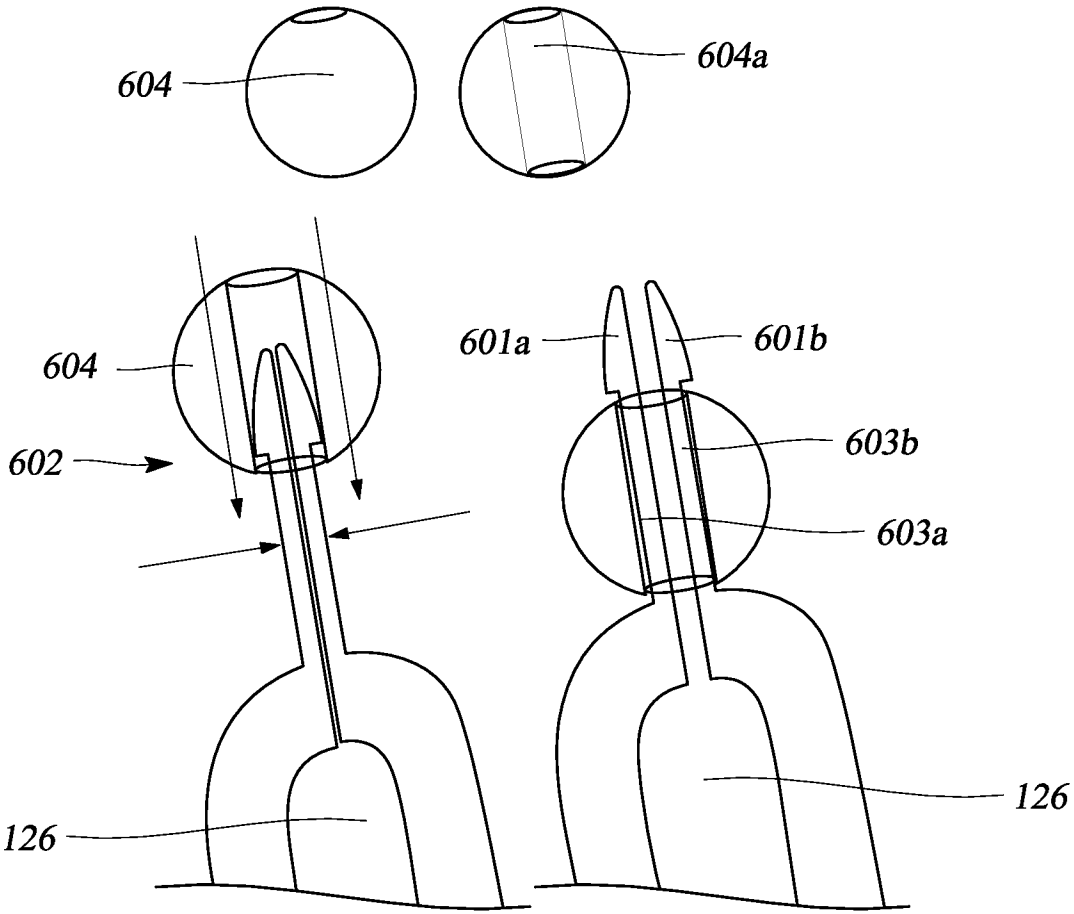
FIG. 10
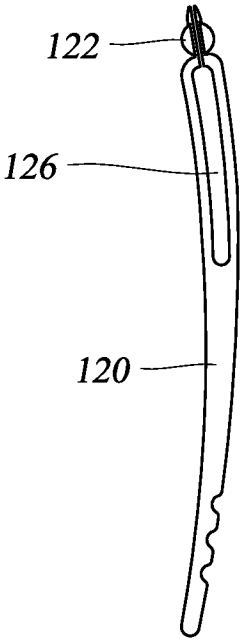

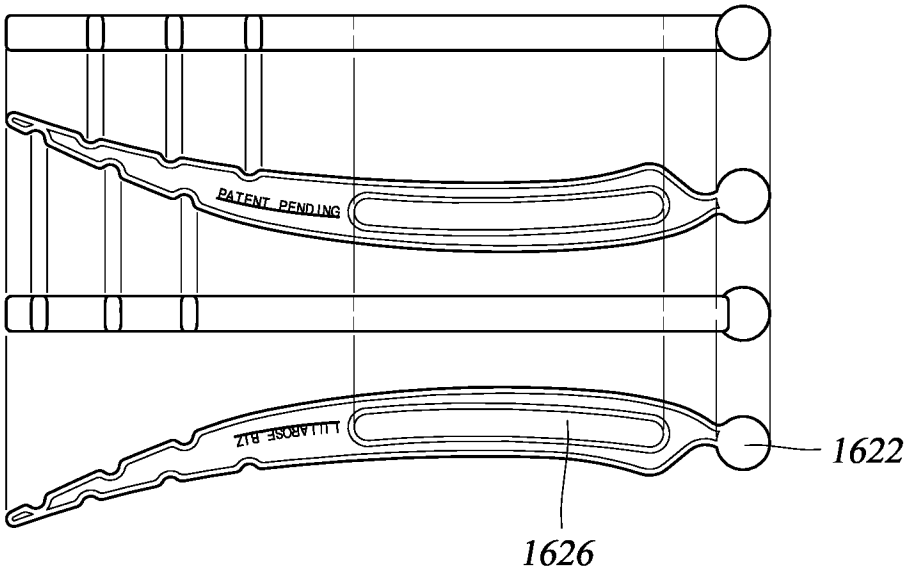
FIG. 15A
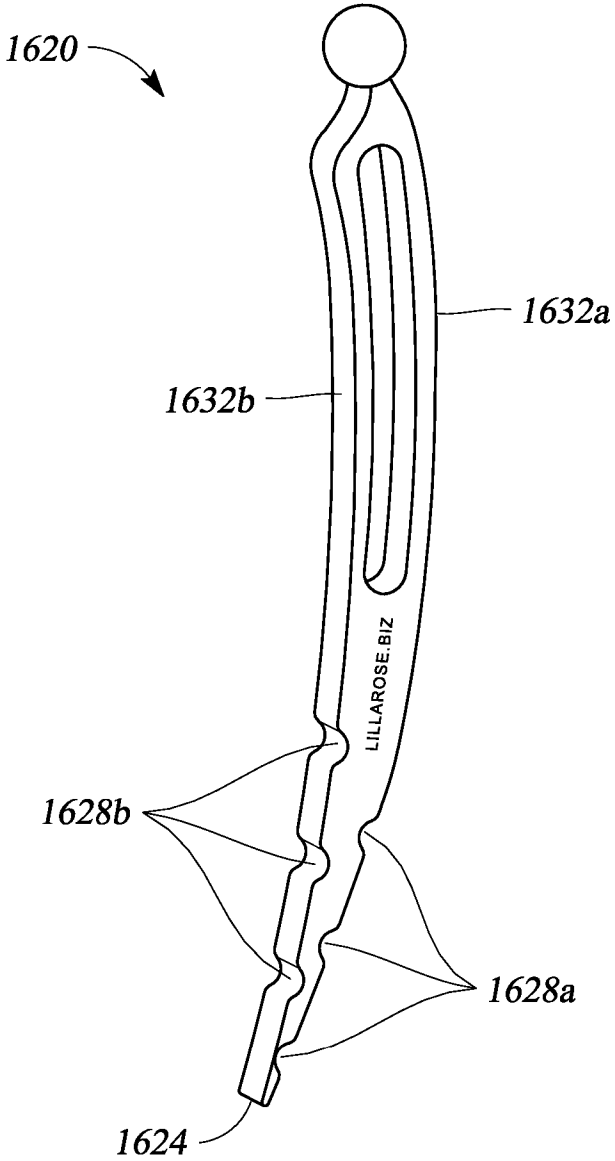

REVERSIBLE HAIRCLIP

INCORPORATION BY REFERENCE TO ANY PRIORITY APPLICATIONS

This application claims priority to U.S. Provisional Application No. 63/034,318, which was filed on Jun. 3, 2020 and is titled "REVERSIBLE HAIRCLIP," the disclosure of which is expressly incorporated by reference herein in its entirety for all purposes. Any and all applications for which a foreign or domestic priority claim is identified in the Application Data Sheet as filed with the present application are hereby incorporated by reference and made a part of the present disclosure.

BACKGROUND

Field

This present disclosure generally relates to hair accessories which can be easily positioned in a user's hair to hold the hair in place and can be decorative.

Description of the Related Art

People with long hair may have problems with their hair hanging over their face and they need a hair accessory to hold their hair back. A wide variety of hairclips are available, but a useful hairclip must incorporate the advantages of easy installation, firm holding of the hair, and the ability to secure different hair thicknesses.

SUMMARY

In some aspects of the disclosure, a reversible hairclip is disclosed. The reversible hairclip may comprise a flexible inelastic band and a curved pin. The flexible inelastic band may comprise a first loop, a second loop, and a middle section. The first loop may comprise a first indented portion at a first end and the second loop may comprise a second indented portion at a second end. The middle section may be positioned between the first and second loops. The flexible inelastic band may further comprise an interior material having spring-like properties and an exterior material. The first loop, the second loop, and the middle section may be arranged to form a figure eight shape. An outer diameter of the first indented portion and an outer diameter of the second indented portion may be smaller than an outer diameter of an adjacent portion of the flexible inelastic band. The first end of the first loop may be spaced from the middle section and the second end of the second loop may be spaced from the middle section. The exterior material may encase the interior material such that the exterior material prevents fluid from contacting the interior material. The curved pin may comprise a first elongate side, a second elongate side, a knob, a tip end opposite the knob, and a slot. The knob may comprise a first portion and a second portion that may be joined together. The knob may be configured to pass through the first loop. The curved pin may comprise a length extending from the knob to the tip end. The slot may be positioned adjacent the knob and may extend along at least a portion of the length of the curved pin toward the tip end. The slot may be configured to receive the first indented portion of the flexible inelastic band and the first indented portion of the flexible inelastic band may be movable within the slot. The tip end may comprise a plurality of notches along the first and second elongate sides and the plurality of notches may be configured to engage with the second indented portion of the flexible inelastic band. The curved pin may be configured to rotate around an axis of the first indented portion such that the plurality of notches along the first or second elongate side of the tip end of the curved pin can engage with the second indented portion.

The reversible hairclip can include one or more of the following features. The interior material may comprise a metal. The exterior material may be configured to be waterproof. The exterior material may comprise a plastic material. The plastic material may comprise a polypropylene material, a thermoplastic elastomer material, or the like. The exterior material may comprise a hardness of approximately Shore 30A. A surface of the exterior material may be configured to grip the hair of the user. The first portion and the second portion of the knob can be sonically welded together during manufacturing. The knob of the curved pin may comprise a ball or a substantially cylindrical structure. The middle section of the flexible inelastic band may comprise a circular structure. The slot of the curved pin may extend substantially halfway along the length of the curved pin. The plurality of notches may be configured to engage with the second indented portion such that the hair of the user may be secured between the curved pin and the flexible inelastic band in use.

In some aspects, a reversible hairclip is disclosed. The reversible hairclip may comprise a flexible inelastic band and a curved pin. The flexible inelastic band may comprise a first loop that may comprise a first end, a second loop that may comprise a second end, and a clamp that may be positioned between the first and second loops. The flexible inelastic band may further comprise an interior material having spring-like properties and an exterior material. The first loop, the second loop, and the clamp may be arranged to form a figure eight shape. The first end of the first loop may be spaced from the clamp and the second end of the second loop may be spaced from the clamp. The exterior material may encase the interior material. The curved pin may comprising a first elongate side, a second elongate side, a knob, a tip end opposite the knob, and a slot. The knob may be configured to pass through the first loop. The curved pin may comprise a length extending from the knob to the tip end. The slot may be positioned adjacent the knob and may extend along at least a portion of the length of the curved pin toward the tip end. The slot may be configured to receive the first end of the flexible inelastic band and the first end of the flexible inelastic band may be movable along the length of the slot. The tip end may comprise at least one notch along the first and second elongate sides. The at least one notch may be configured to engage with the second end of the flexible inelastic band. The curved pin may be configured to rotate around an axis of the first end of the flexible inelastic band such that the at least one notch along the first or second elongate side of the tip end of the curved pin can engage with the second end of the flexible inelastic band.

The reversible hairclip can include one or more of the following features. The interior material may comprise a metal wire. The exterior material may comprise a plurality of beads. The knob of the curved pin may comprise a ball or a substantially cylindrical structure. The slot of the curved pin may extend substantially halfway along the length of the curved pin. The at least one notch may be configured to engage with the second end of the flexible inelastic band such that the hair of the user may be secured between the curved pin and the flexible inelastic band in use. The clamp may comprise a metal material. The clamp may comprise a first loop and a second loop. The first and second loops of the clamp may be configured to receive a first portion and a second portion of the flexible inelastic band.

In some aspects, a reversible hairclip is disclosed. The reversible hairclip may include a flexible inelastic band and a curved pin. The curved pin can be removable from the flexible inelastic band. The curved pin can include a body portion including a tip end opposite a connecting end, a knob that can be removable from the connecting end of the body portion, and a slot. The slot can be positioned adjacent the knob and can extend along at least a portion of the body portion toward the tip end. The slot can receive a first end of the flexible inelastic band and the first end of the flexible inelastic band can be movable along a length of the slot. The tip end can include at least one notch that can engage with a second end of the flexible inelastic band. The curved pin can rotate around an axis of the first end of the flexible inelastic band such that the at least one notch of the tip end of the curved pin can engage with the second end of the flexible inelastic band.

The reversible hairclip can include one or more of the following features. The flexible inelastic band can include a first loop including the first end, a second loop including the second end, and a middle section between the first and second loops. The first end of the first loop can be spaced from the middle section and the second end of the second loop can be spaced from the middle section. The knob can pass through the first loop. The slot can receive the first end of the flexible inelastic band and the first end of the flexible inelastic band can be movable along the length of the slot. The flexible inelastic band can include an interior material having spring-like properties and an exterior material. The exterior material can encase the interior material. The interior material can include a metal wire. The exterior material can include a plurality of beads. The exterior material can be waterproof. The exterior material can include a plastic material. The plastic material can include a polypropylene material, a thermoplastic elastomer material, or the like. The exterior material can include a hardness of approximately Shore 30A. A surface of the exterior material can grip the hair of the user.

The middle section can include a clamp. The clamp can include a metal material. The clamp can include a first loop and a second loop. The first and second loops of the clamp can receive a first portion and a second portion of the flexible inelastic band. The flexible inelastic band can form a figure eight shape. The body portion can include a first elongate side and a second elongate side. The at least one notch can be positioned along the first elongate side and/or the second elongate side of the tip end of the body portion. The curved pin can include a length extending from the knob to the tip end. The slot of the curved pin can extend substantially halfway along the length of the curved pin. The knob of the curved pin can include a ball or a substantially cylindrical structure. The at least one notch can engage with the second end of the flexible inelastic band such that the hair of the user can be secured between the curved pin and the flexible inelastic band in use. The connecting end can include one or more prongs configured to be received by the knob. The knob can include one or more holes. The one or more holes can include a first hole and a second hole. The first hole can extend along a length of the knob. The second hole can extend substantially perpendicularly to the first hole. The first hole can receive the one or more prongs of the body portion. The second hole can receive a securement mechanism that can secure the knob to the connecting end of the body portion. The one or more prongs can include two prongs. The connecting end can include an opening positioned between the two prongs. The opening can receive the securement mechanism.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claim

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments.

FIG. 10 shows an embodiment of a pin of a reversible hairclip according to certain aspects of the disclosure.

FIGS. 15A-15E show different embodiments of a pin of the reversible hairclip according to certain aspects of the disclosure.

DETAILED DESCRIPTION

Reference will now be made in detail to various embodiments of the present technology, which relate to a reversible hairclip. Although certain specific embodiments of the present technology are described, the present technology is not limited to these embodiments. On the contrary, these described embodiments are merely illustrative of the present technology, and the present technology is intended to also cover alternatives, modifications, and equivalents. Furthermore, in the following detailed description, numerous specific details are set forth in order to provide a thorough understanding of the present technology. However, it will be recognized by one of ordinary skill in the art that embodiments can be practiced without these specific details. In some instances, well known methods, procedures, compounds, compositions and mechanisms have not been described in detail as not to unnecessarily obscure aspects of embodiments of the present technology.

Figure 1B:
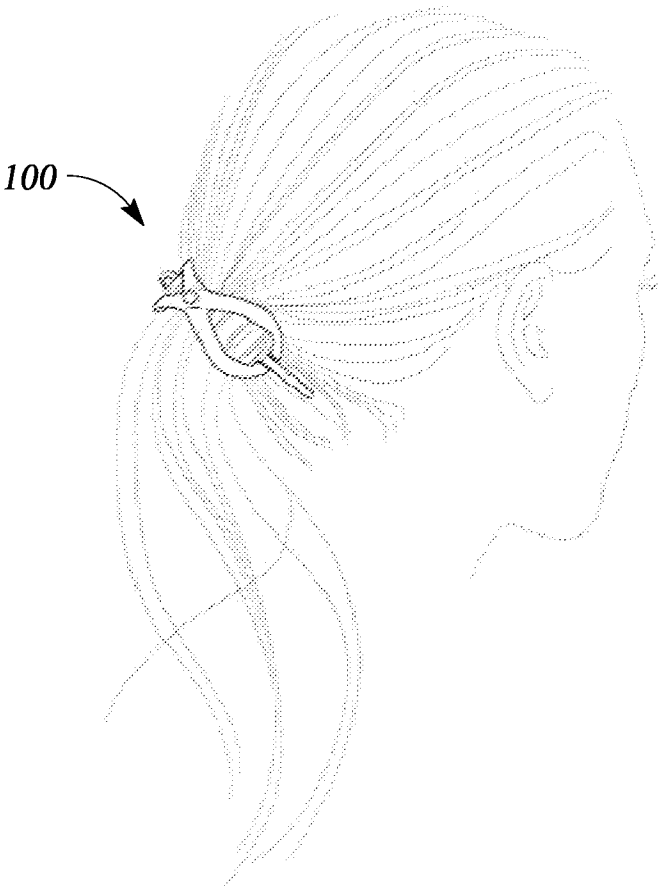
FIGS. 1A-1B show different views of a reversible hairclip being worn by a user according to certain aspects of the disclosure.
Figure 1A:
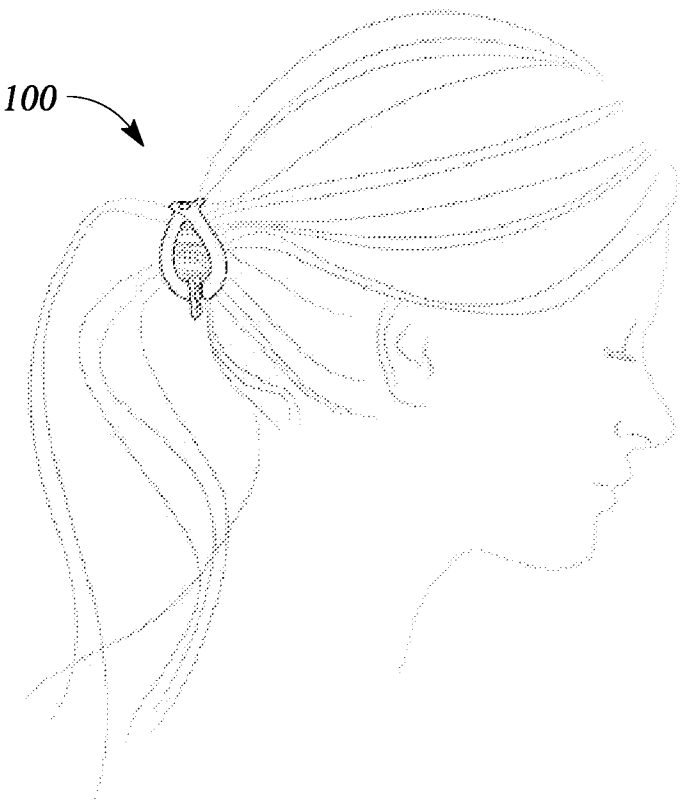

FIGS. 1A-4 illustrate an embodiment of a reversible hairclip 100. As shown in FIGS. 1A-1B, the reversible hairclip 100 may be worn by a user to pull their hair back into a ponytail or other hairstyle. The reversible hairclip 100, as shown in FIGS. 2A-2B, can include a band 110 and a curved pin 120. The band 110 may comprise a generally FIG. 8 shape, though other shapes, such as an oval, a triangle, square, rectangle, or any other shape, design, or pattern can be used as well (e.g., see FIGS. 9A-9C for examples of designs that can be used). Although the band 110 is depicted as substantially straight and the curved pin 120 is depicted as curved, in some embodiments, the band 110 can be curved and the pin 120 can be straight. Moreover, both the band 110 and the pin 120 could be substantially straight or curved.

Figure 3:
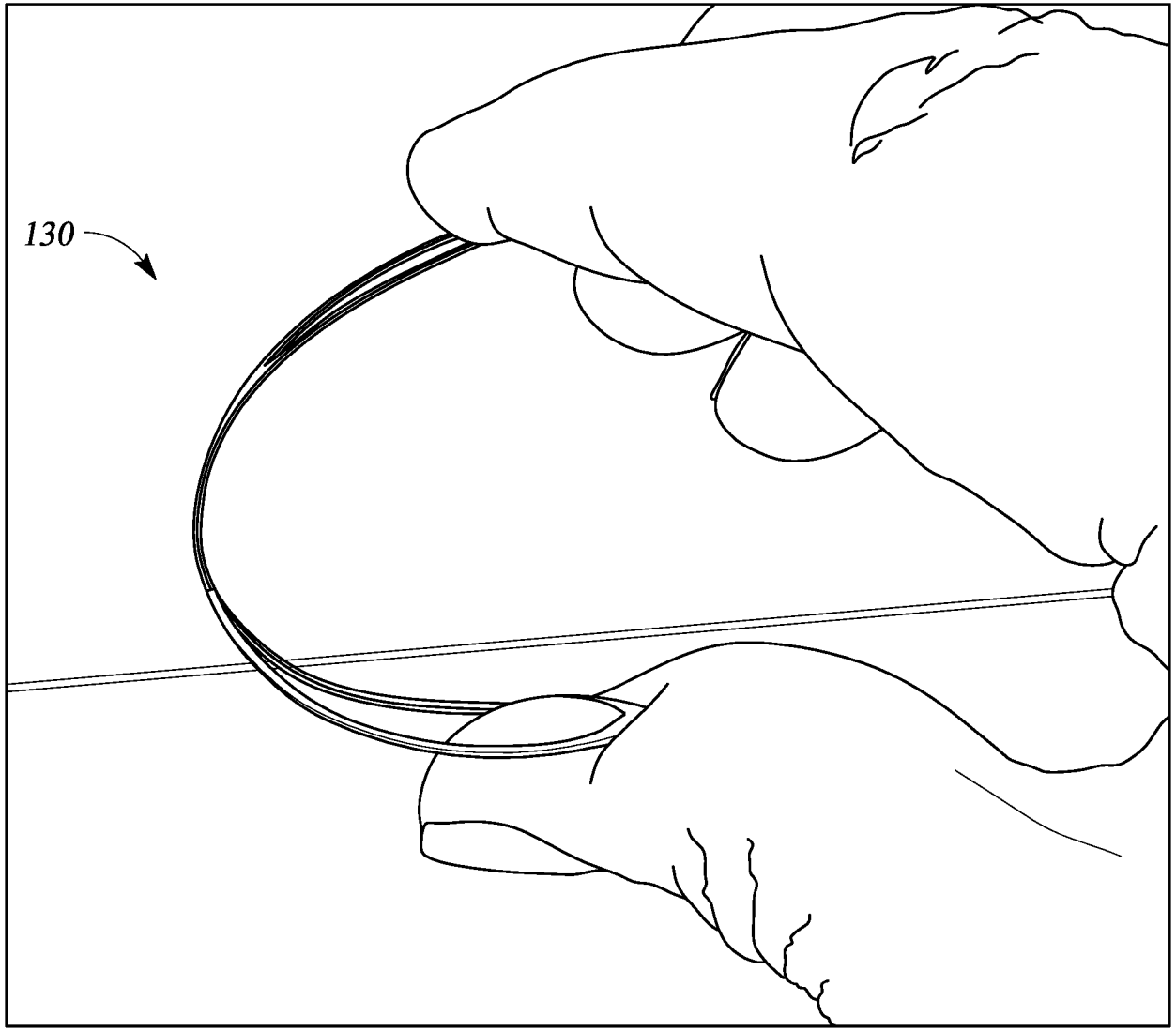
FIG. 3 shows a side view of an internal spring of a reversible hairclip according to certain aspects of the disclosure.

In some aspects, the band 110 can comprise flexible, inelastic material. For example, the band 110 can comprise an interior spring 130 (shown in FIG. 3) coated with an exterior material. The interior spring 130 may comprise a metal or an annealed metal (e.g., zinc, steel) with spring-like properties. For example, the spring 130 may comprise a 0.3 mm cold-rolled spring steel with a hardness rated between about 42-46 Rockwell C. Although specific dimensions and hardnesses are described, other dimensions and hardnesses are contemplated and are within the scope of the present invention. The interior spring 130 is configured to bend, as shown in FIG. 3, such that the reversible hairclip 100 can secure different hair thicknesses and different hairstyles.

The exterior material coating the interior spring 130 may comprise a plastic material, such as polypropylene, thermoplastic elastomer, or the like. The exterior material may comprise a combination of two or more materials. For example, the interior spring 130 can have an injection overmold of polypropylene to provide stabilization in the secondary injection process to prevent the interior spring 130 from moving during the second overmold. Further, the interior spring 130 can have a second injection overmold of thermoplastic elastomer. The shore hardness of the exterior material is configured to sufficiently grip the user's hair in use. In some aspects, the exterior material comprises a shore hardness of about Shore 30A. In some aspects, the exterior material comprises a shore hardness of about Shore 30D to about Shore 10A. Although specific shore hardnesses are described, other shore hardnesses are contemplated and are within the scope of the present invention. A material with the described shore hardness can provide strength that prevents band 110 from indentation or deformation while still allowing the necessary flexibility to conform to the hair and desired curvature. The exterior material can also be resistant enough to bend without cracking or breaking ensuring enclosure and protection of the interior material throughout use and repeated bending of the band 110. In some aspects, the exterior material is waterproof, which prevents the interior spring 130 from contacting a fluid. The combination of the interior spring 130 overmolded with, for example, polypropylene Shore 30A, allows the band 110 to comfortably curve and grip onto objects, which gives the band 110 a flexible grip and soft-touch application. In some variants, the band 110 can comprise a single material.

In some embodiments, the band 110 comprises a first loop 116, a second loop 118, and middle section 114 between the first and second loops 116, 118. The middle section 114 may comprise a circular structure that can be configured to display a label or a logo (e.g., the circular structure 114, 214 shown in FIGS. 2A and 5A). The first and second loops 116, 118 may comprise a first end 115 and a second end 111, respectively. In some aspects, the first end 115 may comprise a first indented portion 113 and the second end 111 may comprise a second indented portion 112. The first and second indented portions 113, 112 can comprise outer diameters that are smaller than the outer diameter of the remainder of the band 110.

In some aspects, the band 110 may comprise a length of between approximately 40 millimeters to approximately 120 millimeters, approximately 50 millimeters to approximately 110 millimeters, approximately 60 millimeters to approximately 110 millimeters, approximately 70 millimeters to approximately 100 millimeters, or approximately 80 millimeters to approximately 90 millimeters. In some aspects, the band 110 may comprise a width of between approximately 10 millimeters to 50 millimeters, approximately 15 millimeters to approximately 45 millimeters, approximately 20 millimeters to approximately 40 millimeters, or approximately 25 millimeters to approximately 35 millimeters. Although specific lengths are described, other lengths of the band 110 are contemplated and are within the scope of the present invention.

As described above, the reversible hair clip 100 can include a curved pin 120. The curved pin 120 may comprise any suitable material, such as a metal (e.g., zinc, steel) or a plastic (e.g., polycarbonate, glass-reinforced polycarbonate). In some aspects, the curved pin 120 may comprise a radius of curvature of approximately 160 millimeters. In some aspects, the curved pin 120 may comprise a radius of curvature of between approximately 120 millimeters to approximately 180 millimeters, approximately 130 millimeters to approximately 170 millimeters, or approximately 140 millimeters to approximately 150 millimeters. In some aspects, the curved pin 120 may comprise a length of between approximately 50 millimeters to approximately 150 millimeters, approximately 60 millimeters to approximately 140 millimeters, approximately 70 millimeters to approximately 130 millimeters, approximately 80 millimeters to approximately 120 millimeters, or approximately 90 millimeters to approximately 110 millimeters. Although specific lengths are described, other lengths of the curved pin 120 are contemplated and are within the scope of the present invention.

Figure 4:
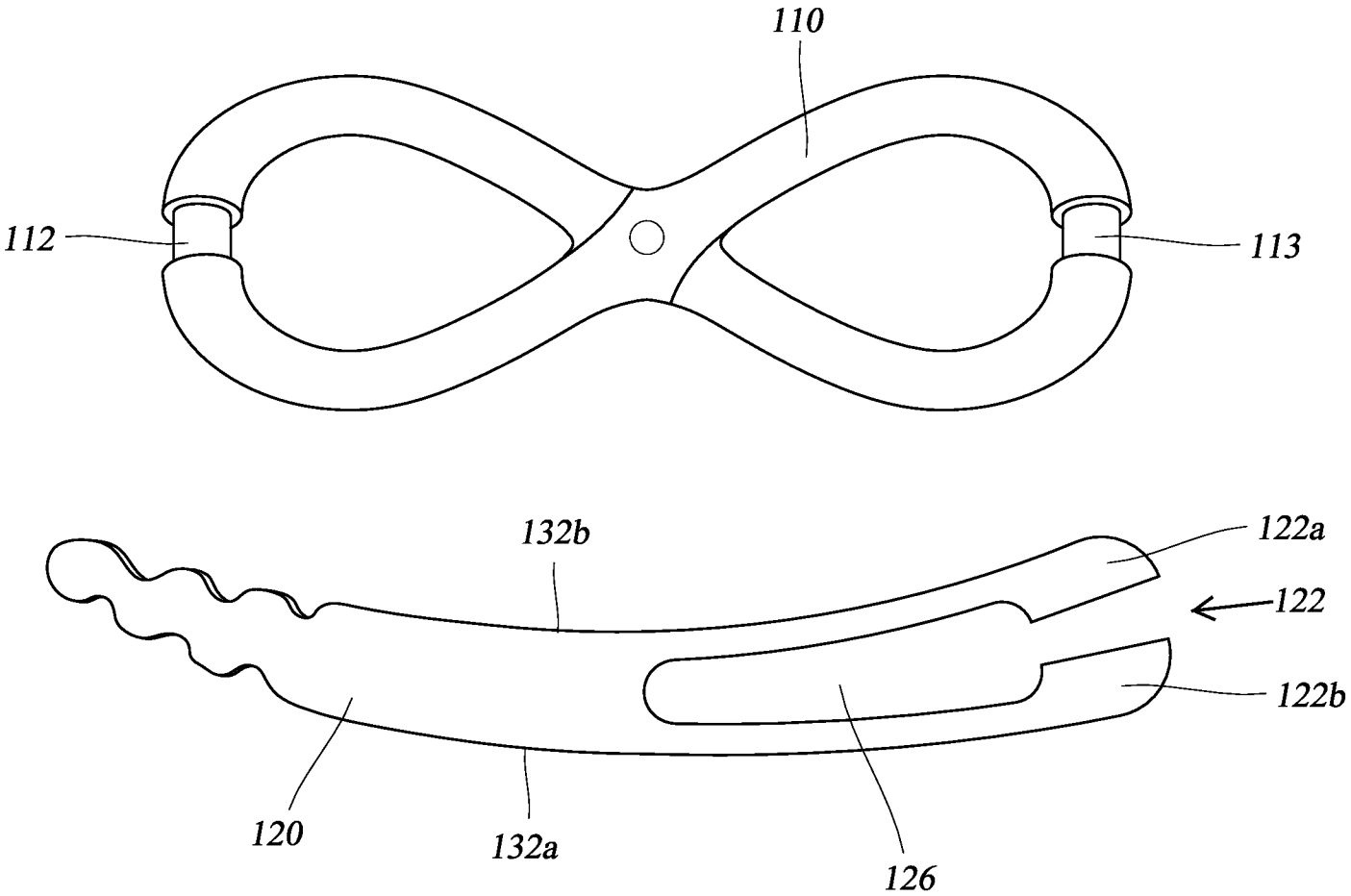
FIG. 4 shows the pin of the reversible hair clip and the band of the reversible hairclip according to certain aspects of the disclosure.

In some embodiments, the curved pin 120 may comprise a knob 122, a slot 126, and a tip end 124. As shown in FIG. 4, the knob 122 of the curved pin 120, according to some embodiments, can comprise a first portion 122*a* and a second portion 122*b*. During manufacturing, the first indented portion 113 of the band 110 can be inserted between the first and second portions 122*a*, 122*b* of the knob 122 and into the slot 126. After the band 110 is inserted into the slot 126, the first and second portions 122*a*, 122*b* of the knob 122 can be sonically welded together, adhered together, welded together, or otherwise attached. The knob 122 can comprise a generally circular shape as well as other shapes, such as a generally cylindrical shape (e.g., the knob 222 shown in FIGS. 5A-5B). In some embodiments, the knob 122 is configured to pass through the first loop 116 of the band 110 such that the curved pin 120 may rotate about the band 110, as further described below with reference to FIG. 2B.

In some aspects, the slot 126 of the curved pin 120 may comprise a length of between approximately 10 millimeters to approximately 80 millimeters, approximately 20 millimeters to approximately 70 millimeters, approximately 30 millimeters to approximately 60 millimeters, or approximately 40 millimeters to approximately 50 millimeters. Although specific lengths are described, other lengths of the slot 126 are contemplated and are within the scope of the present invention.

Figure 2A:
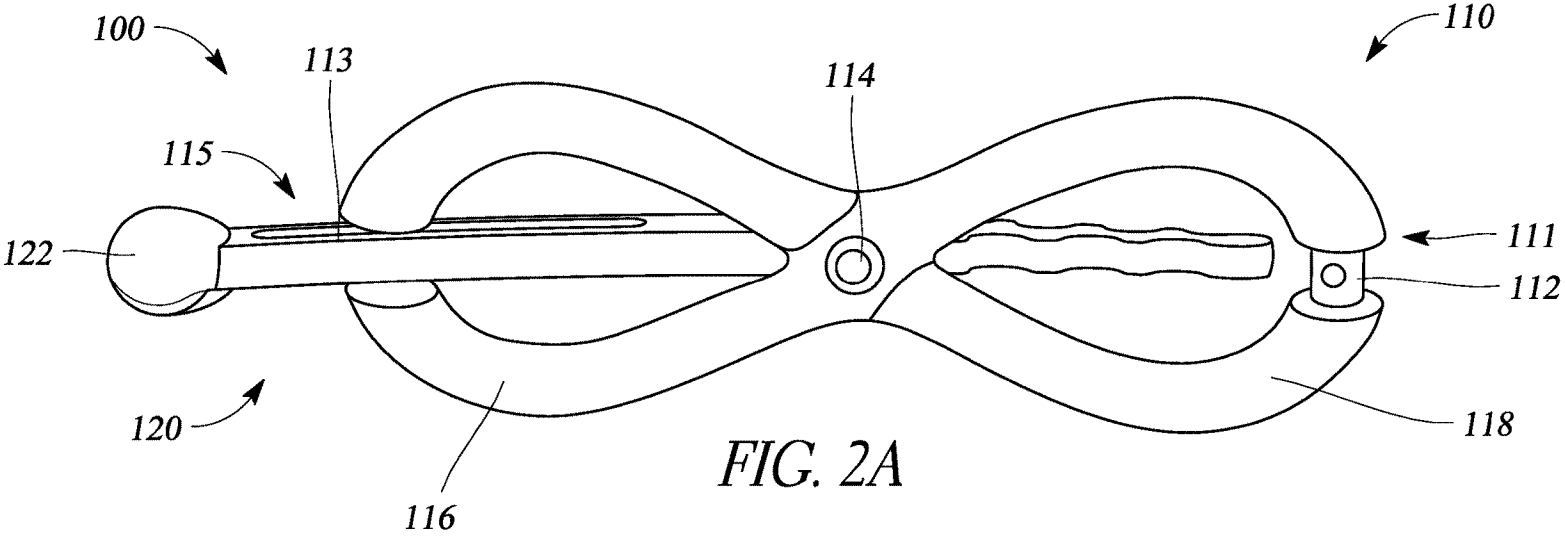
FIGS. 2A-2B show different views of a reversible hairclip according to certain aspects of the disclosure.
Figure 2B:
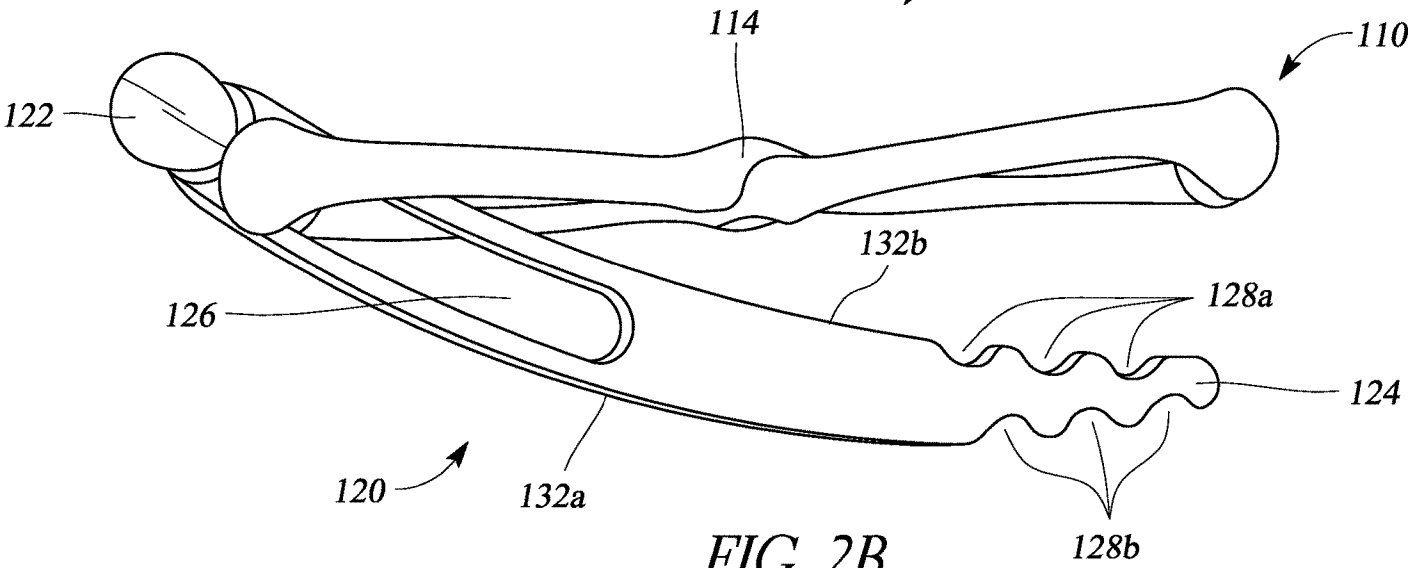

As described above, the curved pin 120 can comprise a rigid material, such as plastic, that maintains the curvature of the curved pin 120. Referring to FIG. 2B, in some embodiments, the curved pin 120 may comprise a plurality of notches 128*a* on a second longitudinal side 132*b* (e.g., a concave side) of the curved pin 120 adjacent the tip end 124 and a plurality of notches 128*b* on a first longitudinal side 132*a* (e.g., a convex side) of the curved pin 120 adjacent the tip end 124. The plurality of notches 128*a*, 128*b* can include any number of notches (e.g., two notches, three notches, four notches, five notches, or more than five notches). In some configurations, the curved pin 120 may comprise a single notch 128*a*, 128*b* on the first longitudinal side 132*a* and/or the second longitudinal side 132*b*. The number of notches 128*a* on the second longitudinal side 132*b* can be the same or different than the number of notches 128*b* on the first longitudinal side 132*a*. For example, the first longitudinal side 132*a* may have no notches and the second longitudinal side 132*b* may have two notches 128*a*. Alternatively, the first longitudinal side 132*a* may have two notches 128*b* and the second longitudinal side 132*b* may have four notches 128*a*. In some aspects, the plurality of notches 128*a*, 128*b* may be configured to engage with the second indented portion 112 to secure the user's hair in use. In some aspects, the plurality of notches 128*a*, 128*b* can be configured to retain the tip end 124 of the pin within the second loop 118 of the band 110.

In some aspects, the slot 126 of the curved pin 120 may be configured to receive the first indented portion 113 of band 110. The first indented portion 113 of the band 110 can be configured to move along the length of the slot 126. The curved pin 120 may be configured to rotate about an axis of the band 110 that runs through the length of the first indented portion 113 such that the knob 122 of the pin 120 can pass through the first loop 116. The curved pin's 120 ability to rotate about the first indented portion 113 of the band 110 allows the plurality of notches 128*a*, 128*b* on the concave and convex sides 132*b*, 132*a* of the pin 120 to be able to engage with the second indented portion 112 of the band 110. This rotation, the plurality of notches 128*a*, 128*b* on both sides of the pin 120, and the concave and convex sides 132*b*, 132*a* of the pin 120 allow the hairclip 100 to be reversible and to accommodate different hair thicknesses and different hairstyles. For example, a user with thick hair may use a notch of the plurality of notches 128*a*, 128*b* closest to the tip end 124 to secure their hair with the pin 120. Or the user may wear the hairclip 100 such that the hair of the user is secured between the band 110 and the concave side 132*b* of the curved pin 120. Alternatively, a user with thinner hair may use a notch of the plurality of notches 128*a*, 128*b* furthest from the tip end 124. Or the user may wear the hairclip 100 such that the hair of the user is secured between the band 110 and the convex side 132*a* of the curved pin 120. Moreover, a user may use the hairclip 100 with one hairstyle and rotate the curved pin 120 about the band 110 to wear the hairclip 100 with a different hair style.

Other embodiments of the reversible hairclip, the curved pin and the band are illustrated in FIGS. 5A-11. FIGS. 5A-12 show embodiments of the hairclip, the curved pin, and the band that are similar to the hairclip 100, the curved pin 120, and the band 110 described with reference to FIGS. 2A and 2B and can have similar features. Reference numerals of the same or substantially the same features may share the same last two digits. The hairclip 200 shown in FIG. 5A has a curved pin 220 (FIG. 5B) with a cylindrically shaped knob 222. The curved pin 220 can include a slot 226 between first and second portions 222*a*, 222*b* of the curved pin 220. The knob 222 can comprise a unitary structure that can secure the first portion 222*a* of the curved pin 220 and the second portion 222*b* of the curved pin 220. For example, the first and second portions 222*a*, 222*b* of the curved pin 220 can each include a coupling end (not shown) at an end opposite the tip end 224 of the curved pin 220. The coupling ends of the first and second portions 222*a*, 222*b* can be received by the knob 222. The first and second portions 222*a*, 222*b* of the curved pin 220 can have a wider cross section along the curved pin 220 relative to the tip end 224 and/or the coupling ends. In some configurations, the slot 226 can be located within the wider cross section of the curved pin 220. This embodiment may also include a band 210 with a middle section 214 that comprises a circular structure 214. The circular structure 214 can be configured to display a label or a logo. The band 210 can include a first indented portion 213 and a second indented portion 212. The first indented portion 213 can be inserted into the slot 226 between the first and second portions 222*a*, 222*b* of the curved pin 220. The knob 222 can secure the band 210 within the slot 226 by securing the first and second portions 222*a*, 222*b*.

Figure 5B:
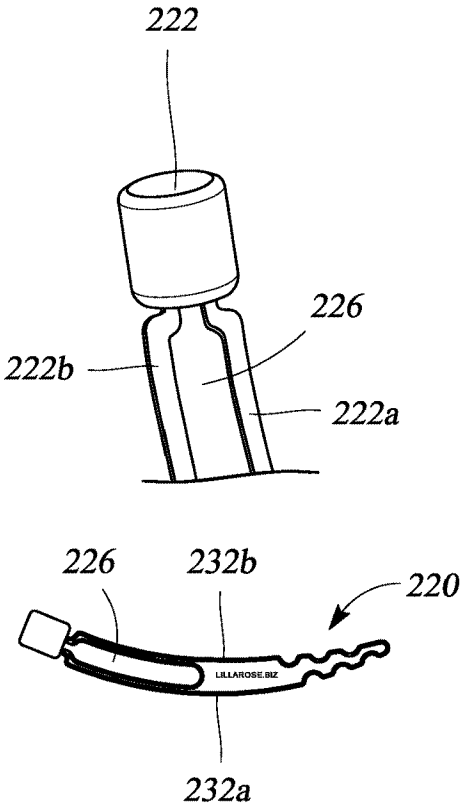
FIGS. 5A-5B show an embodiment of a reversible hair clip, according to certain aspects of the disclosure.
Figure 5A:
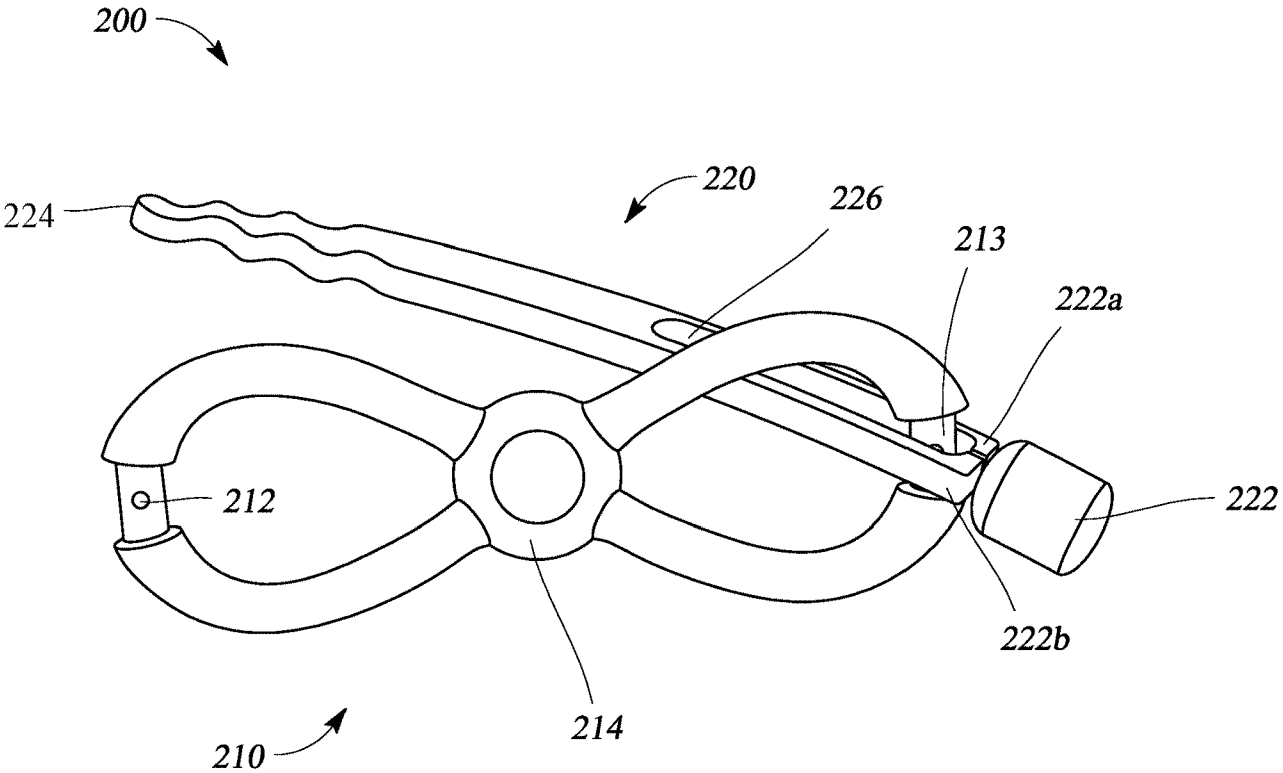
Figure 6B:
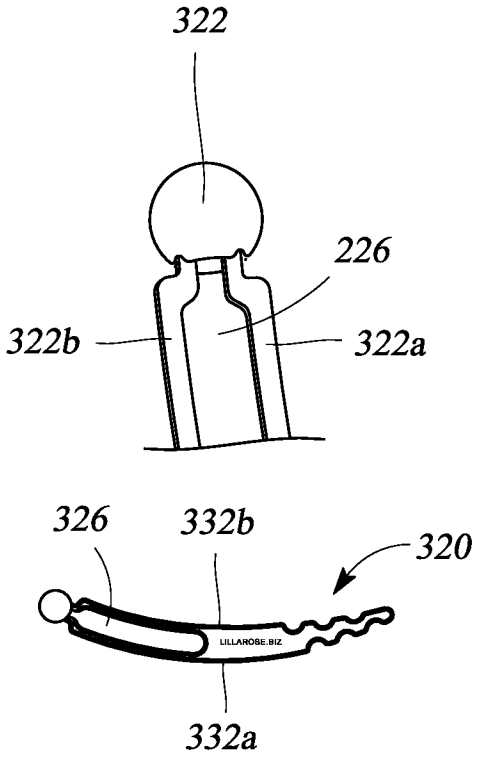
FIGS. 6A-6B show an embodiment of a reversible hair clip according to certain aspects of the disclosure.
Figure 6A:
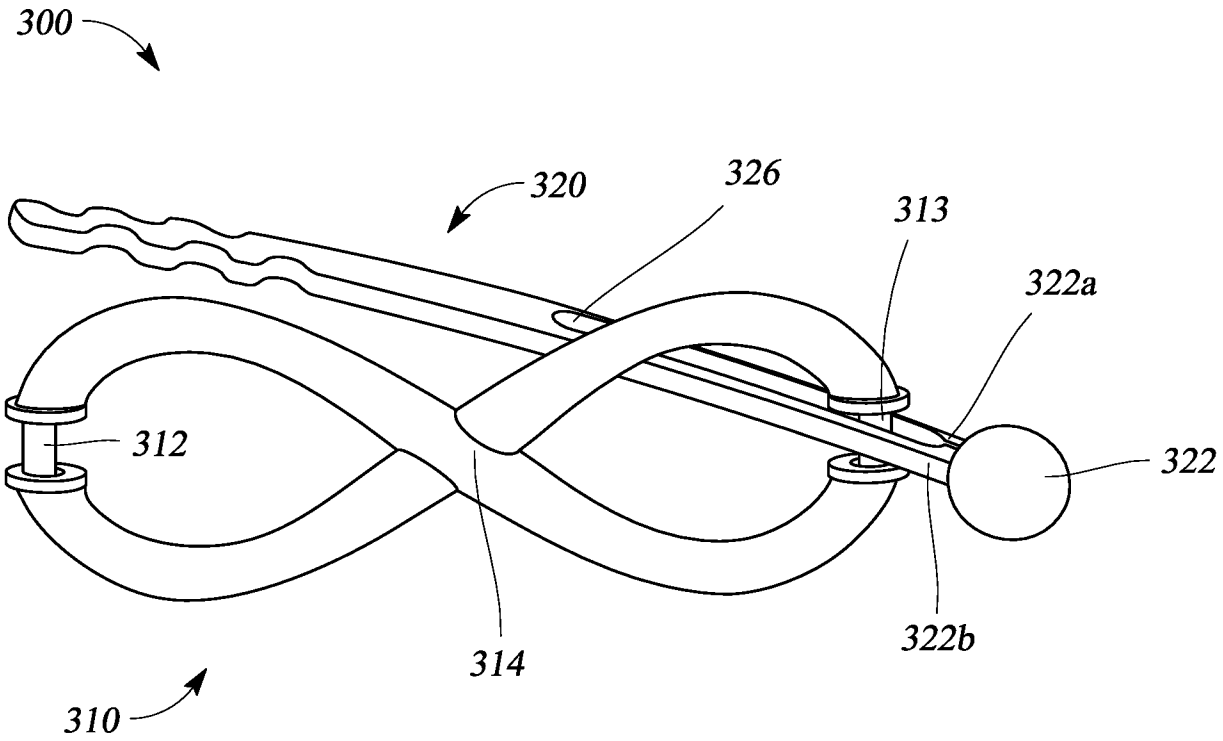

The hairclip 300 shown in FIGS. 6A-6B is similar to the embodiment of the hairclip 200 shown in FIGS. 5A-5B. The knob 322 of the curved pin 320 comprises a circular shape and the band 310 does not include a circular structure in the middle portion 314.

Figure 7:
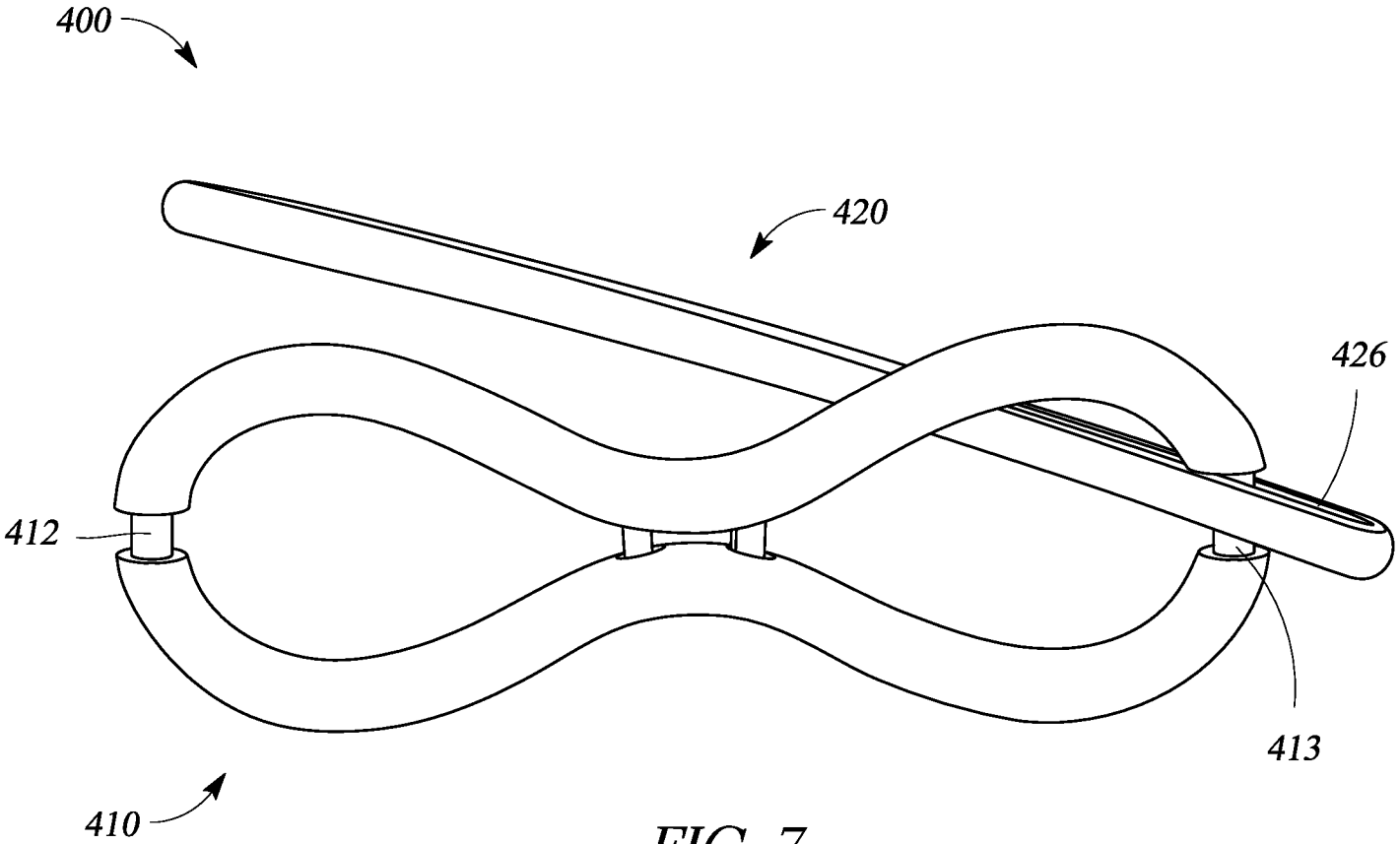
FIG. 7 shows an embodiment of a reversible hair clip according to certain aspects of the disclosure.
Figures 8A, 8B, 8C:
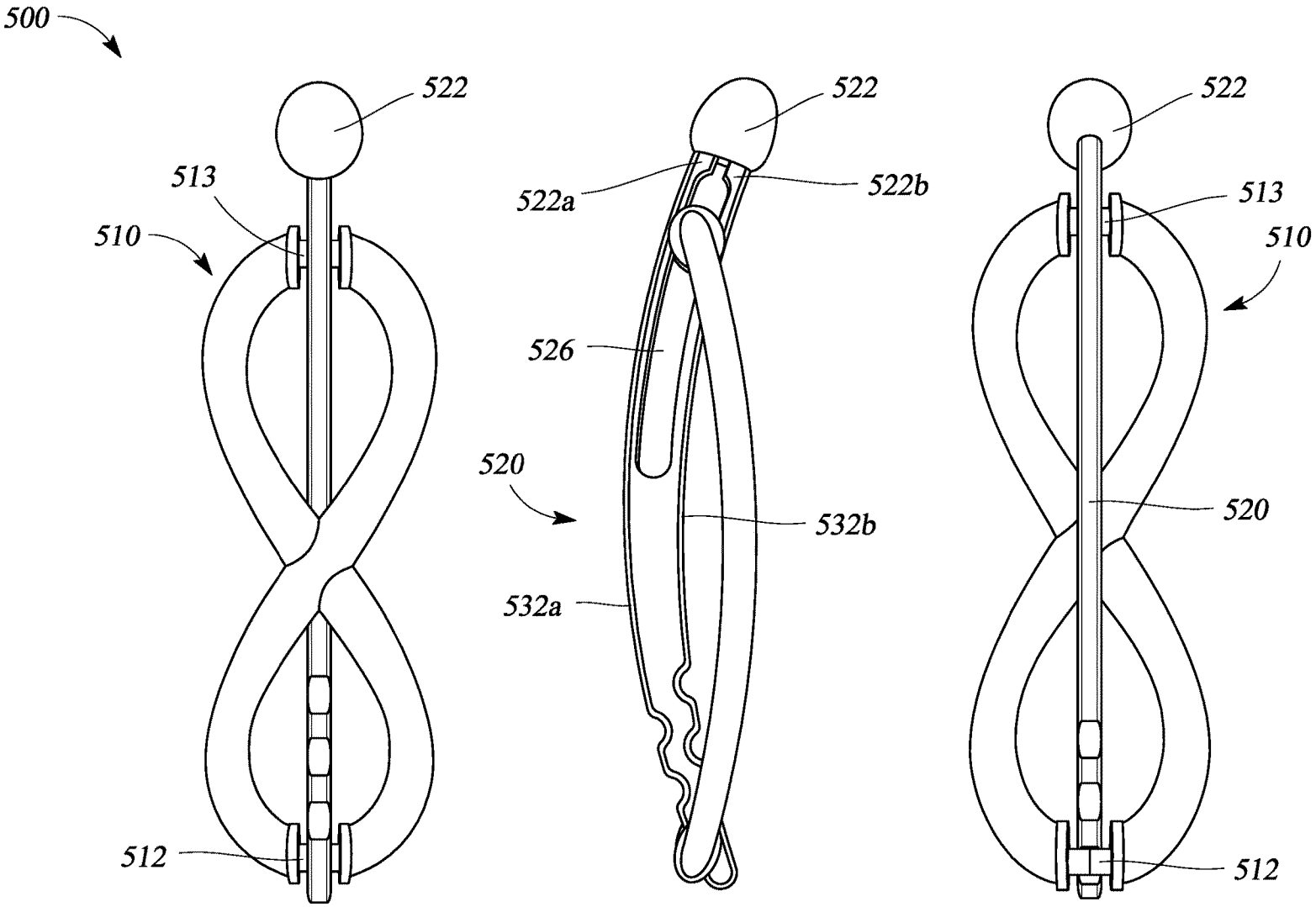
FIGS. 8A-8C show an embodiment of a reversible hair clip according to certain aspects of the disclosure.

In the embodiment of the hairclip 400 shown in FIG. 7, the curved pin 420 does not include a knob or a plurality of notches. FIG. 8A illustrates a top view of the hairclip 500, FIG. 8B illustrates a side view of the hairclip 500, and FIG. 8C illustrates a bottom view of the hairclip 500. The knob 522 of the hairclip 500 can comprise a unitary structure configured to secure first and second portions 522*a*, 522*b* of the curved pin 520.

Figure 9C:
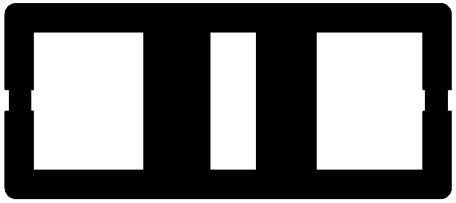
FIGS. 9A-9C show different embodiments of a band of a reversible hairclip according to certain aspects of the disclosure.
Figure 9B:
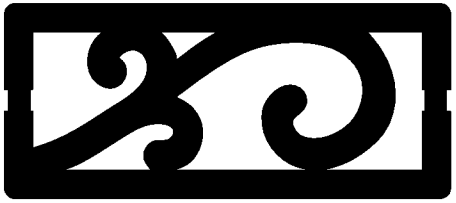
Figure 9A:
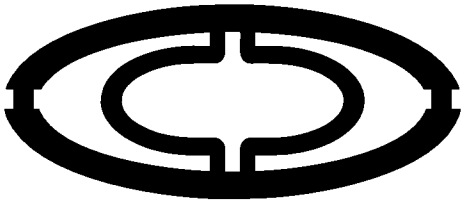

FIGS. 9A-9C show different embodiments of the band 810, 910, 1010 that comprise different shapes. In some embodiments, as shown in FIG. 10, the curved pin 120 comprises a knob 122 comprising a barb tip 602 and a bead 604. The bead 604 can comprise a hole 604*a* that extends through the bead 604. The barb tip 602 can have a first portion comprising a barbed section 601*a* and a neck section 603*a* and a second portion comprising a barbed section 601*b* and a neck section 603*b*. During manufacturing, the first indented portion 113 of the band 110 can be inserted into the slot 126 of the pin 120. The barbed sections 601*a*, 601*b* of the barb tip 602 may be pushed together and inserted into the hole 604*a* of the bead 604 until the neck sections 603*a*, 603*b* are inside the hole 604*a* of the bead 604. The barbed sections 601*a*, 601*b* can be released, thereby securing the bead 604 onto the neck section 603*a*, 603*b* and securing the band 110 within the slot 126 of the curved pin 120.

Figure 11:
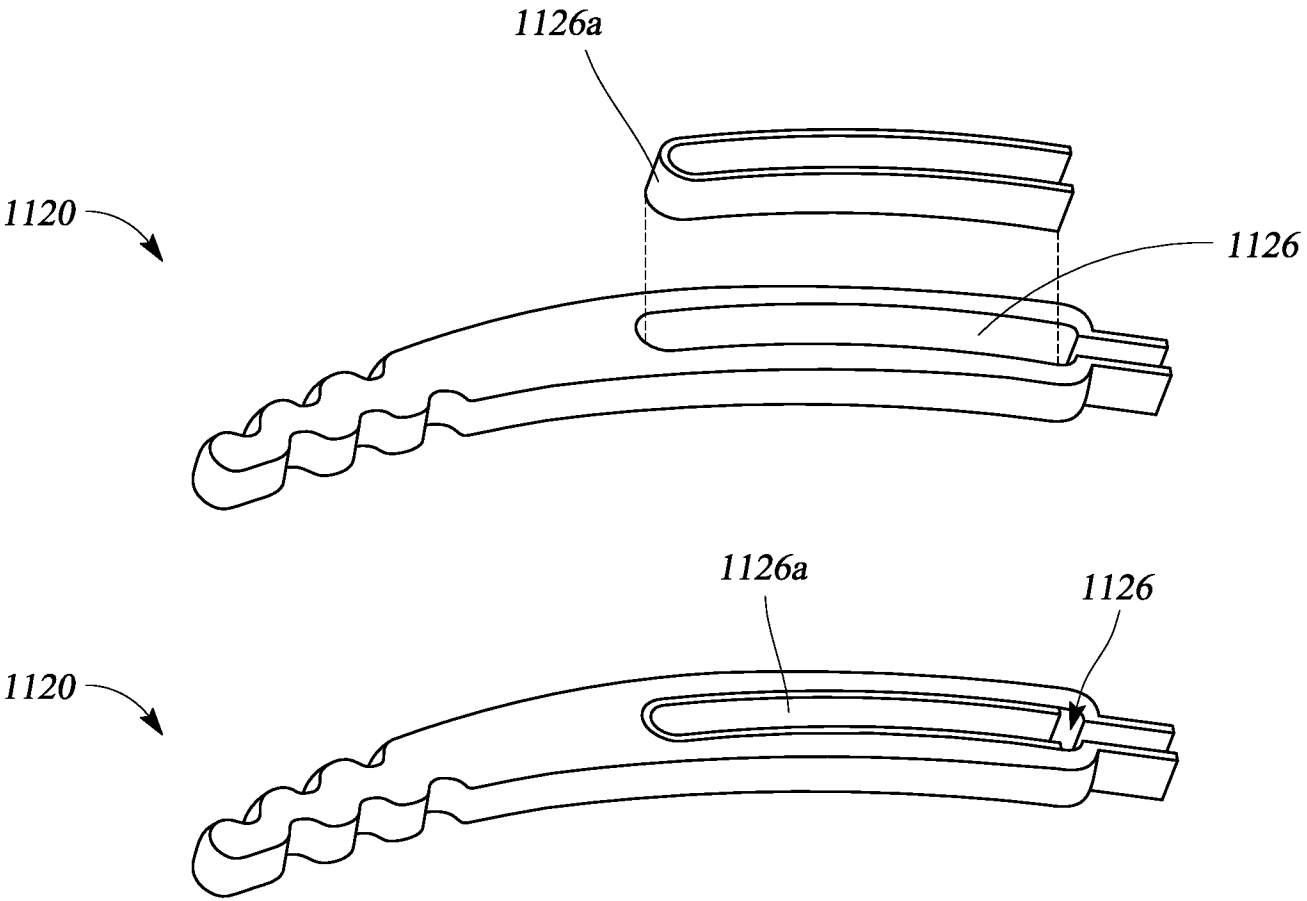
FIG. 11 shows an embodiment of a pin of a reversible hairclip according to certain aspects of the disclosure.
Figure 12B:
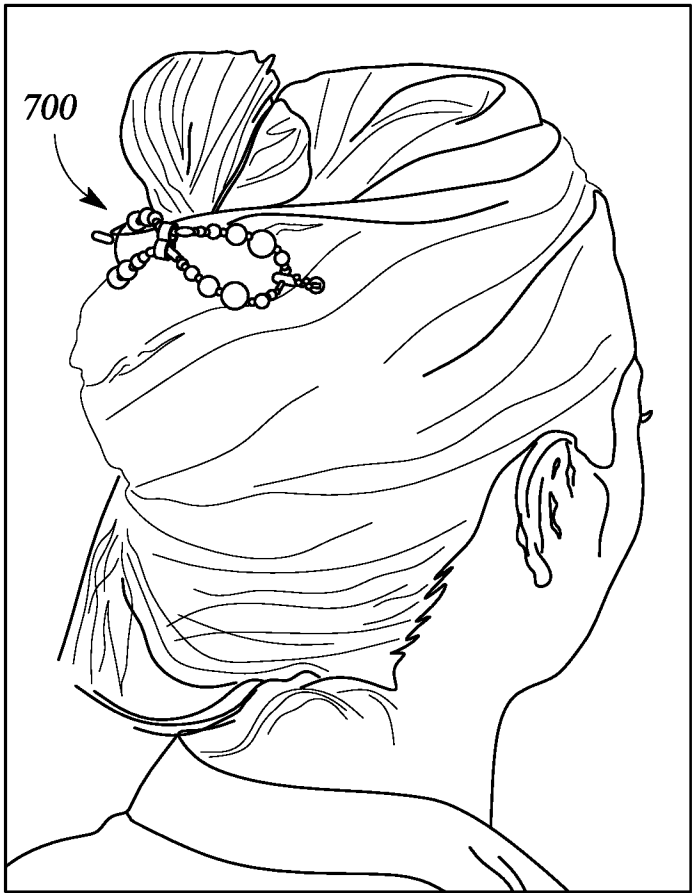
FIGS. 12A-12B show different views of another embodiment of a reversible hairclip being worn by a user according to certain aspects of the disclosure.
Figure 12A:
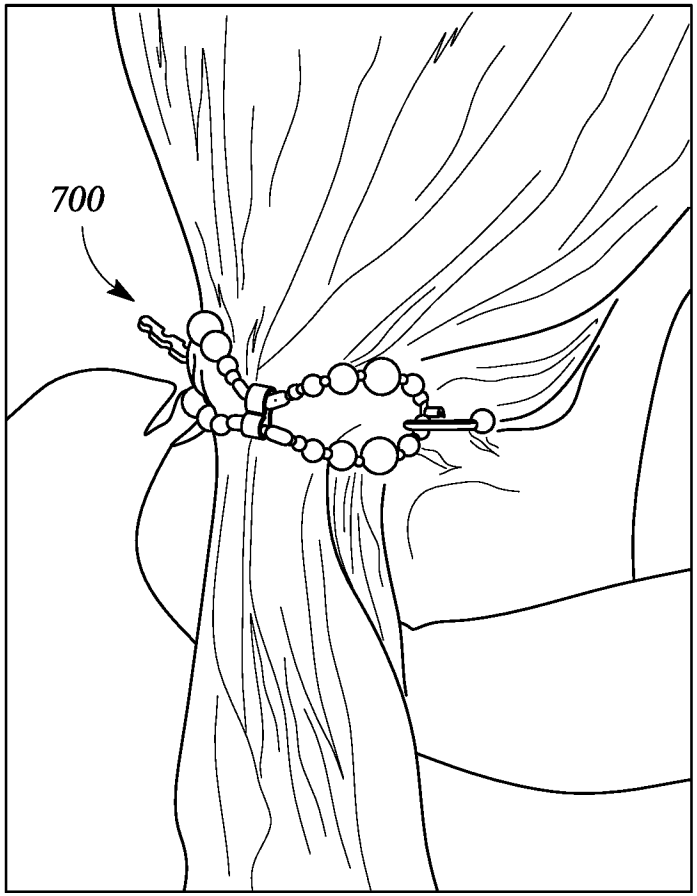

As shown in FIG. 11, in some cases, the curved pin 1120 can comprise a flat metal spring 1126*a* that is glued, pressure fit, or otherwise secured into the slot 1126 of the curved pin 1120. The flat metal spring 1126*a* may strengthen the curved pin 1120 and provide added support to help prevent the curved pin 1120 from breaking.

Figure 13:
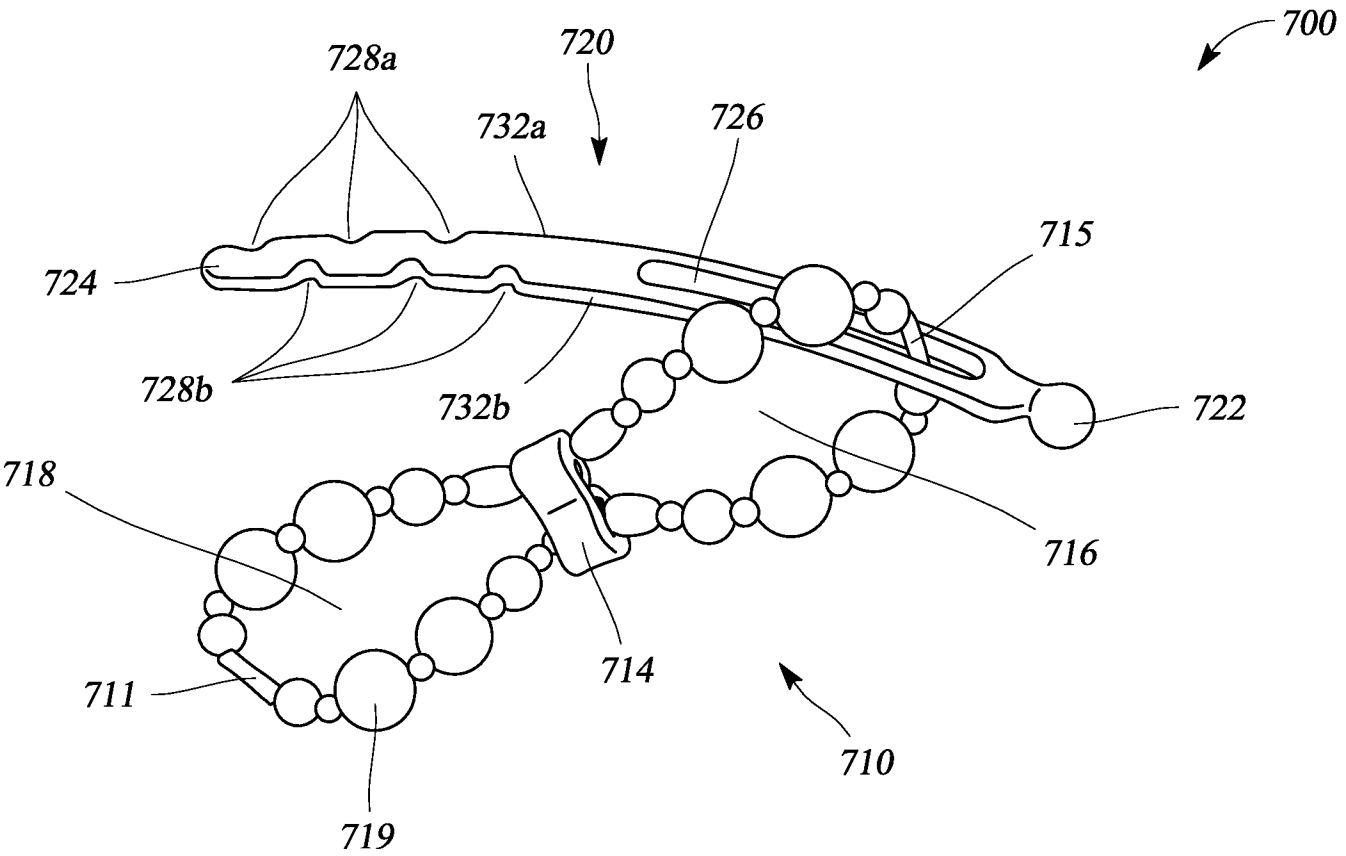
FIG. 13 shows a perspective view of the reversible hairclip shown in FIGS. 12A-12B.
Figure 14B:
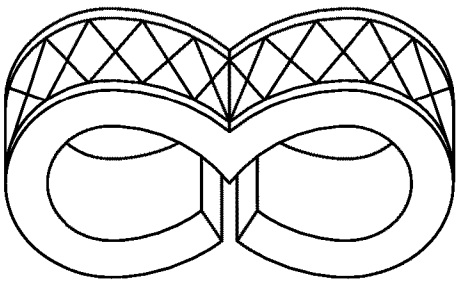
FIGS. 14A-14D show different views of an embodiment of a clamp of the reversible hairclip according to certain aspects of the disclosure.
Figure 14D:
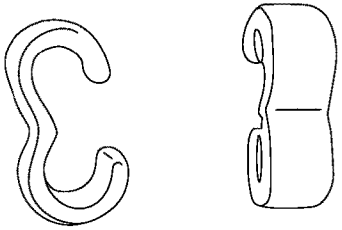
Figure 14A:
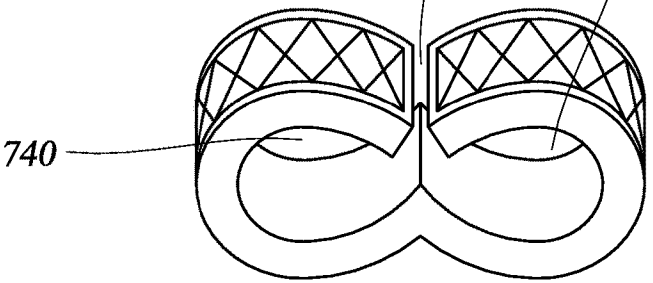
Figure 14C:
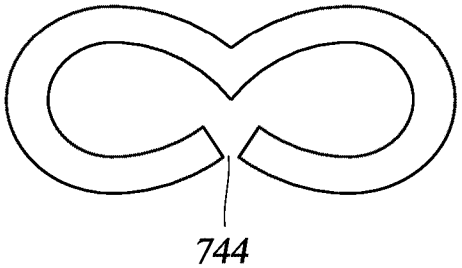

Embodiments of a reversible hairclip that incorporate a decorative element are illustrated in FIGS. 12A-15E. As shown in FIG. 13, the reversible hairclip 700 can comprise a curved pin 720 and a band 710. The band 710 may comprise a generally FIG. 8 shape, though other shapes, such as an oval, a triangle, square, rectangle, or any other shape, design, or pattern can be used as well (e.g., see FIGS. 9A-9C for examples of designs that can be used). In some aspects, the band 710 can comprise an interior portion and an exterior portion. The interior portion may comprise a metal wire (e.g., zinc). The interior portion can be configured to bend such that the reversible hairclip 700 can secure different hair thicknesses and accommodate different hair styles. In some aspects, the exterior portion may comprise decoration, such as beads 719 (see FIGS. 12A-13).

In some embodiments, the band 710 comprises a first loop 716, a second loop 718, and clamp 714 between the first and second loops 116, 118. The first and second loops 716, 718 may comprise a first end 715 and a second end 711, respectively. The first end 715 may be configured to be moveably received in the slot 726 of the curved pin 720, described further below. The second end 711 may be configured to engage with the plurality of notches 728*a*, 728*b* of the curved pin 720 such that the user's hair is secured between the band 710 and the pin 720 in use.

FIGS. 14A-14D illustrate different views of the clamp 714. The clamp 714 can have a generally FIG. 8 shape with a first loop 740 and a second loop 742. The first and second loops 740, 742 of the clamp 714 may be configured to receive portions of the band 710 (shown in FIG. 13). The clamp 714 may comprise a metal material (e.g., zinc or steel) but other materials, such as a plastic material (e.g., polycarbonate), may also be used. In some aspects, the clamp 714 may comprise dimensions sufficient to provide a platform for a user's hair to push against to create more tension in the band 710 in use. In some aspects, the clamp 714 may also comprise an opening 744. During manufacturing, the portions of the band 710 may be inserted into the first or second loop 740, 742 via the opening 744. After the two portions of the band 710 are inserted into the first and second loops 740, 742, the two sides of the clamp 714 may be pushed together such that the band 710 is secured.

As shown in FIG. 13, the reversible hairclip 700 may comprise a curved pin 720. The curved pin 720 may be cast molded and comprise any suitable material, such as a metal (e.g., zinc, steel) or a plastic (e.g., polycarbonate, glass-reinforced polycarbonate). In some aspects, the curved pin 720 may comprise a radius of curvature of approximately 160 millimeters. In some aspects, the curved pin 720 may comprise a radius of curvature of between approximately 120 millimeters to approximately 180 millimeters, approximately 130 millimeters to approximately 170 millimeters, or approximately 140 millimeters to approximately 150 millimeters. In some aspects, the curved pin 720 may comprise a length of between approximately 50 millimeters to approximately 150 millimeters, approximately 60 millimeters to approximately 140 millimeters, approximately 70 millimeters to approximately 130 millimeters, approximately 80 millimeters to approximately 120 millimeters, or approximately 90 millimeters to approximately 110 millimeters. Although specific dimensions are described, other radii of curvature and lengths of the curved pin 720 are contemplated and are within the scope of the present invention.

In some embodiments, the curved pin 720 may comprise a knob 722, a slot 726, and a tip end 724. The tip end 724 may include a plurality of notches 728*a*, 728*b* adjacent both sides of the tip end 724. The plurality of notches 728*a*, 728*b* may be configured to engage with the second end 711 of the band 710. The number of notches along the tip end 724 may vary (e.g., see FIGS. 15A-15E). The slot 726 of the curved pin 720 may be configured to receive the first end 715 of the band 710. The first end 715 of the band 710 may move along the length of the slot 726. Additionally, the curved pin 720 may rotate about an axis of the band 710 that runs through the length of the first end 715. The curved pin's 720 ability to rotate about the band 710 allows the plurality of notches 728*a*, 728*b* on both sides of the pin 720 to be able to engage with the second end 711 of the band 710. In some embodiments, the hairclip 700 has two configurations. In a first configuration, the hair of the user can be secured between the concave side of the pin 720 and the band 710. In a second configuration, the hair of the user can be secured between the convex side of the pin 720 and the band 710. Thus, the user may use the hairclip 700 in the first configuration for a first hairstyle then change to the second configuration for a second hairstyle by rotating the curved pin 720 with respect to the band 710. In some variants, the two opposite sides of the band 710 may be ornamented differently (e.g., different colors, different patterns). This allows the user to wear the reversible hairclip 700 in a first configuration to match with a first outfit and in a second configuration to match with a second outfit.

FIGS. 15A-15E show different embodiments of a curved pin 1620, 1720, 1820, 1920, 2020 that are similar to the curved pin 120, 220, 320, 420, 520, 720, 1120 described with reference to FIGS. 2A-2B, 4-8C, 10-11, and 13 and can have similar features. Reference numerals of the same or substantially the same features may share the same last two digits. Any of the reversible hairclip 100, 200, 300, 400, 500, 700 described herein may come in different sizes (e.g., small, medium, and large) to accommodate different hair types and different hair styles. Therefore, the curved pin 1620, 1720, 1820, 1920, 2020 may comprise different dimensions for the different sizes of the hairclip 100, 200, 300, 400, 500, 700, which are shown in FIGS. 15A-15E.

Additionally, the curved pin 1620, 1720, 1820, 1920, 2020 may comprise a different number of notches along the tip end 1624, 1724, 1824, 1924, 2024 of the curved pin 1620, 1720, 1820, 1920, 2020.

FIG. 15A illustrates an extra-small/small curved pin 1620 with three notches 1628*a* on a first longitudinal side 1632*a* of the curved pin 1620 and three notches 1628*b* on a second longitudinal side 1632*b* of the curved pin 1620. In some aspects, the extra-small/small curved pin 1620 may comprise a length of approximately 70 millimeters to approximately 85 millimeters. In some aspects, the extra-small/small curved pin 1620 may comprise a width of approximately 3.2 millimeters. In some aspects, the extra-small/small curved pin 1620 may comprise a slot 1626 with a length of approximately 25 millimeters to approximately 31 millimeters. In some aspects, the extra-small/small curved pin 1620 may comprise a knob 1622 with a diameter of approximately 5.2 millimeters. Although specific dimensions are described, other dimensions are contemplated and are within the scope of the present invention.

Figure 15B:
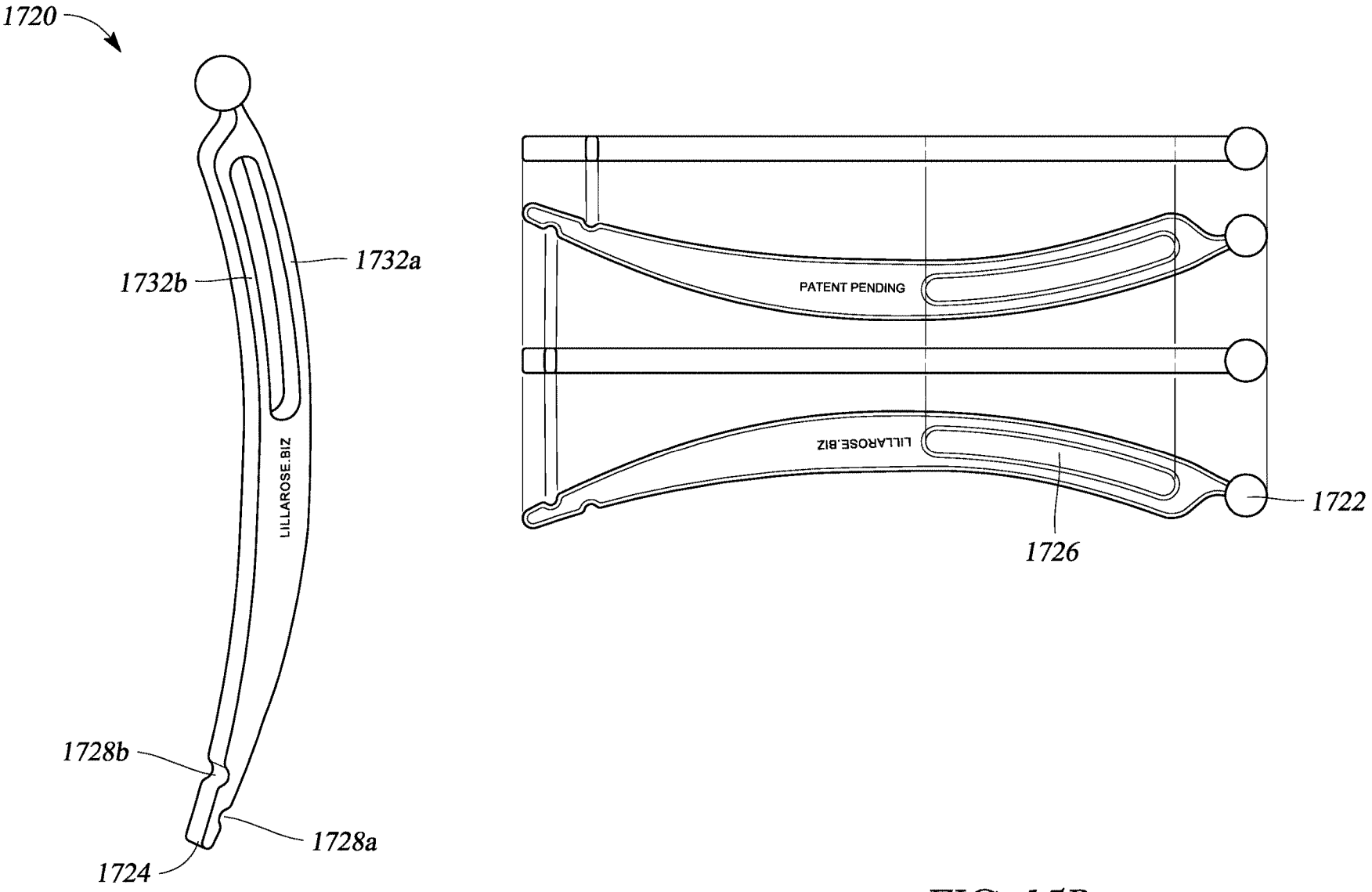
Figure 15C:
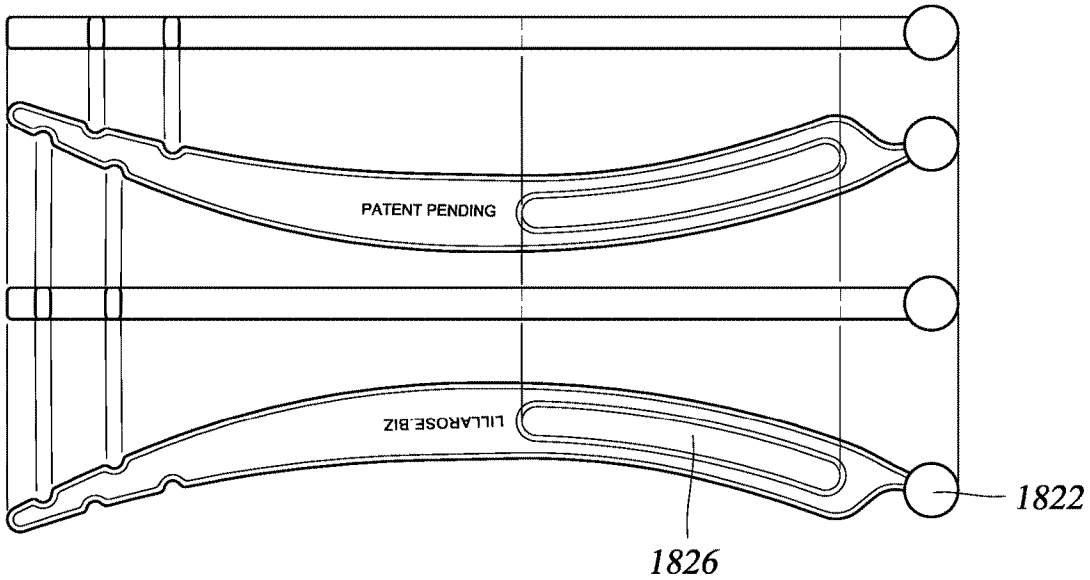
Figure 15C:
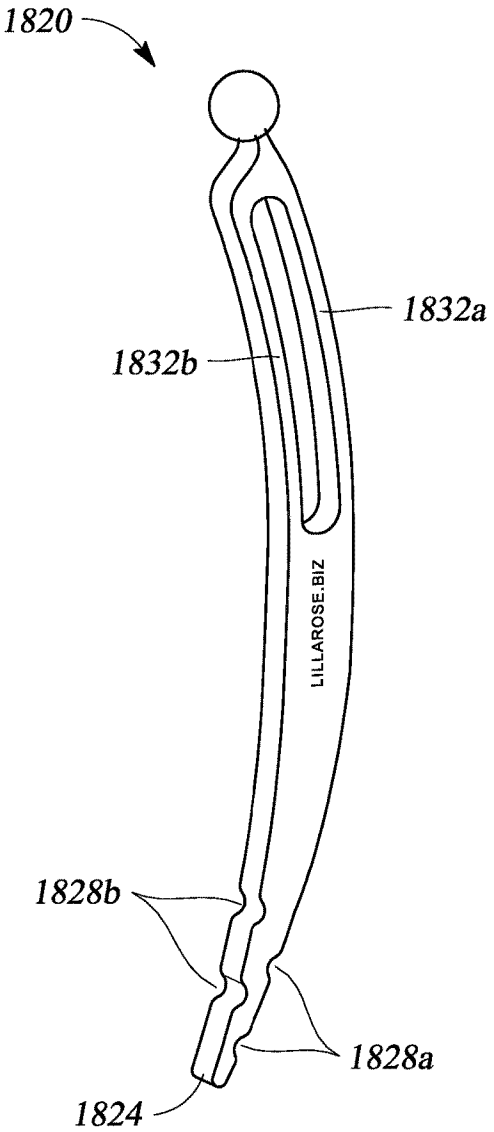
Figure 15D:
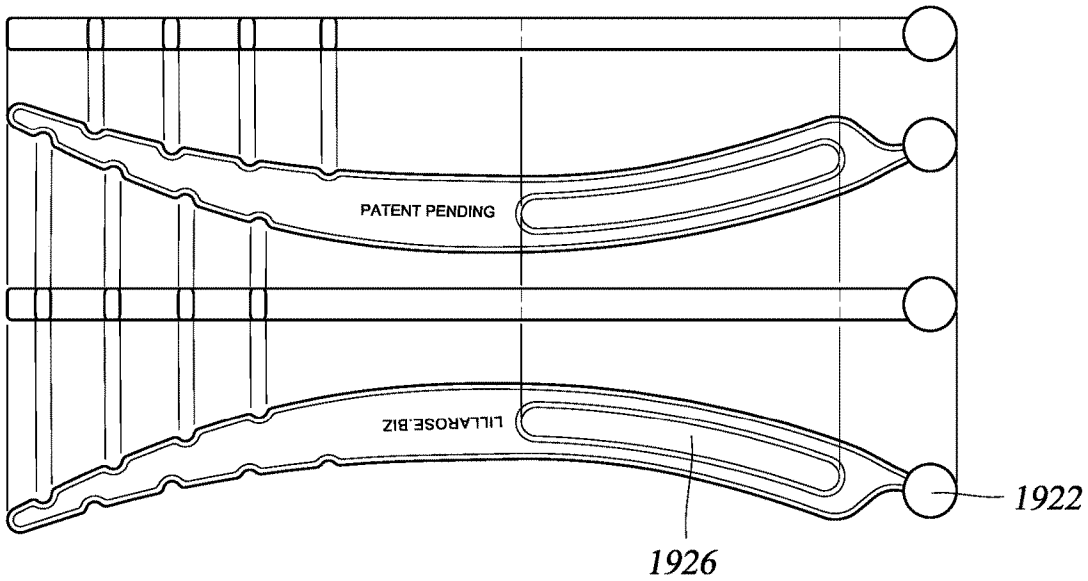
Figure 15D:
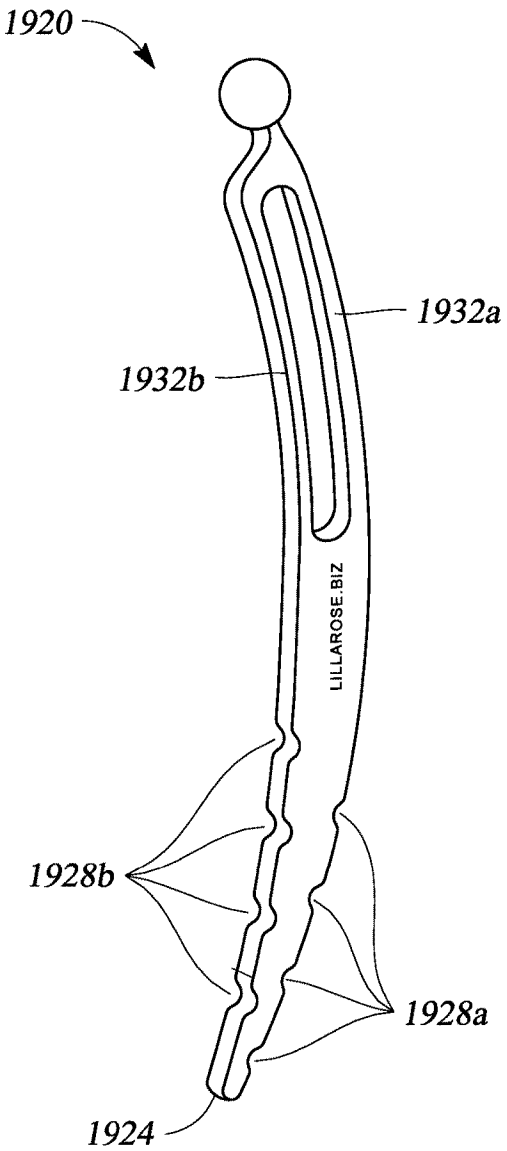

FIGS. 15B-15D illustrate a medium/large curved pin 1720, 1820, 1920 that comprise a different number of notches near the tip end 1724, 1824, 1924 of the curved pin 1720, 1820, 1920. The curved pin 1720 in FIG. 15B comprises a first notch 1728*a* on a first longitudinal side 1732*a* of the curved pin 1720 and a second notch 1728*b* on a second longitudinal side 1732*b* of the curved pin 1720. The curved pin 1820 in FIG. 15C comprises two notches 1828*a* on a first longitudinal side 1832*a* of the curved pin 1820 and two notches 1828*b* on a second longitudinal side 1832*b* of the curved pin 1820. The curved pin 1920 in FIG. 15D comprises four notches 1928*a* on a first longitudinal side 1932*a* of the curved pin 1920 and four notches 1928*b* on a second longitudinal side 1932*b* of the curved pin 1920. In some aspects, the medium/large curved pin 1720, 1820, 1920 may comprise a length of approximately 90 millimeters to approximately 105 millimeters. In some aspects, the medium/large curved pin 1720, 1820, 1920 may comprise a width of approximately 3 millimeters. In some aspects, the medium/large curved pin 1720, 1820, 1920 may comprise a slot 1726, 1826, 1926 with a length of approximately 31 millimeters to approximately 40 millimeters. In some aspects, the medium/large curved pin 1720, 1820, 1920 may comprise a knob 1726, 1826, 1926 with a diameter of approximately 5.4 millimeters. Although specific dimensions are described, other dimensions are contemplated and are within the scope of the present invention.

Figure 15E:
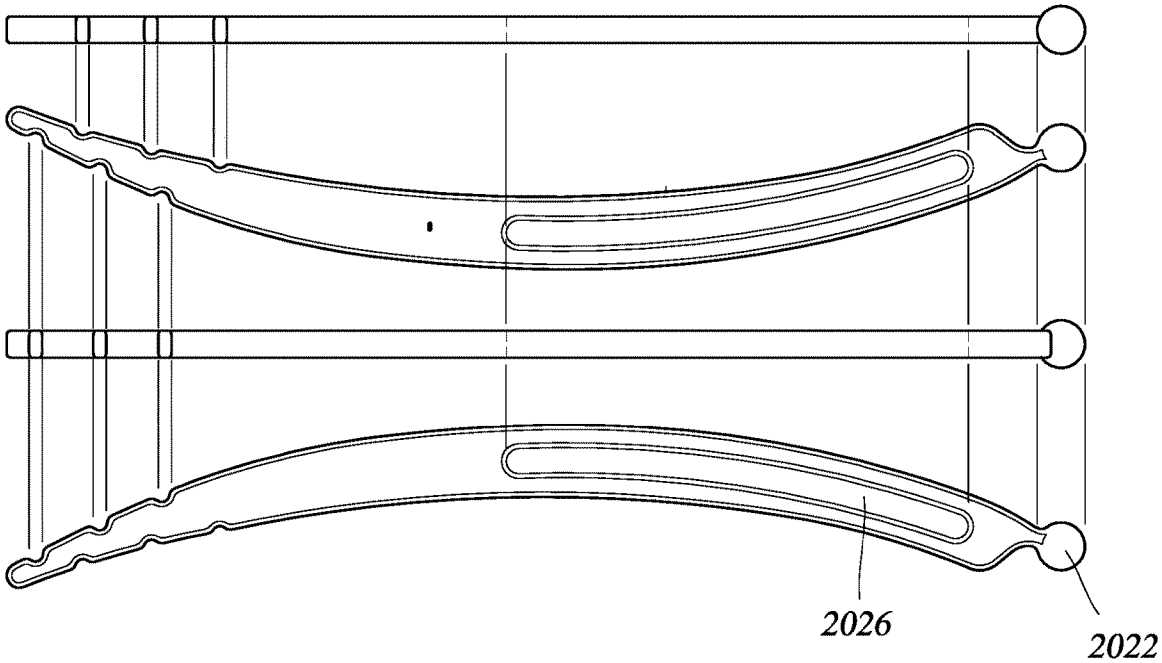
Figure 15E:
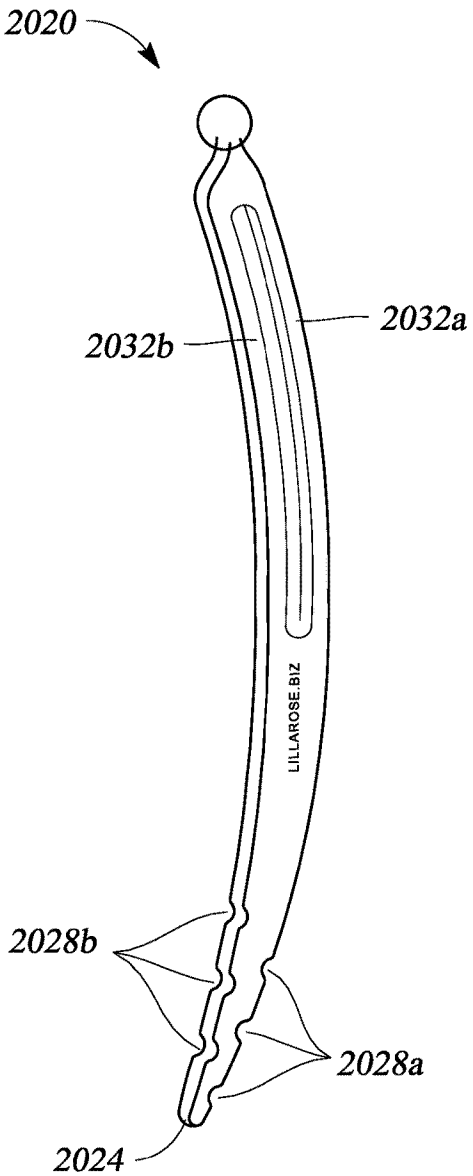

FIG. 15E illustrates a large/extra-large curved pin 2020 with three notches 2028*a* on a first longitudinal side 2032*a* of the curved pin 2020 and three notches on a second longitudinal side 2032*b* of the curved pin 2020. In some aspects, the large/extra-large curved pin 2020 may comprise a length of approximately 110 millimeters to approximately 125 millimeters. In some aspects, the large/extra-large curved pin 2020 may comprise a width of approximately 3 millimeters. In some aspects, the large/extra-large curved pin 2020 may comprise a slot 2026 with a length of approximately 45 millimeters to approximately 55 millimeters. In some aspects, the large/extra-large curved pin 2020 may comprise a knob 2022 with a diameter of approximately 5.4 millimeters. Although specific dimensions are described, other dimensions are contemplated and are within the scope of the present invention.

FIGS. 16A-16L illustrate different views and components of a curved pin 2120. The curved pin 2120 can have similar features as the curved pins 120, 220, 320, 420, 520, 720, 1120, 1620, 1720, 1820, 1920, 2020 described herein. Reference numerals of the same or substantially the same features may share the same last two digits. For example, the curved pin 2120 can be made of any of the materials or combination of materials as described herein. Additionally, the curved pin 2120 can come in different sizes (e.g., small, medium, and large) as described above in relation to FIGS. 15A-15E.

Figure 16B:
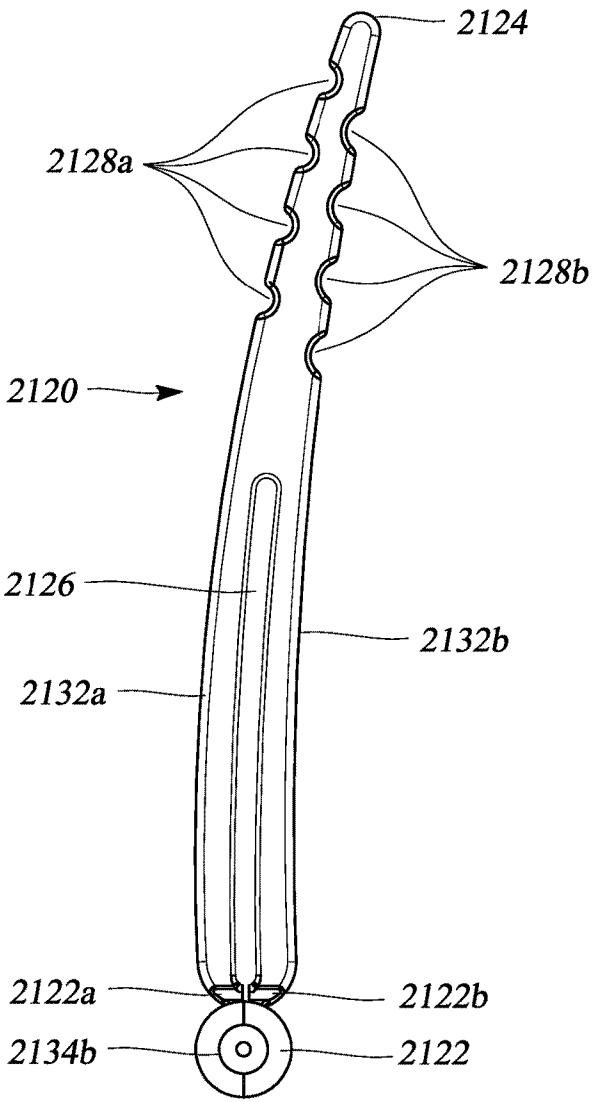
FIG. 16B shows a second side view of the configuration of the pin shown in FIG. 16A.
Figure 16A:
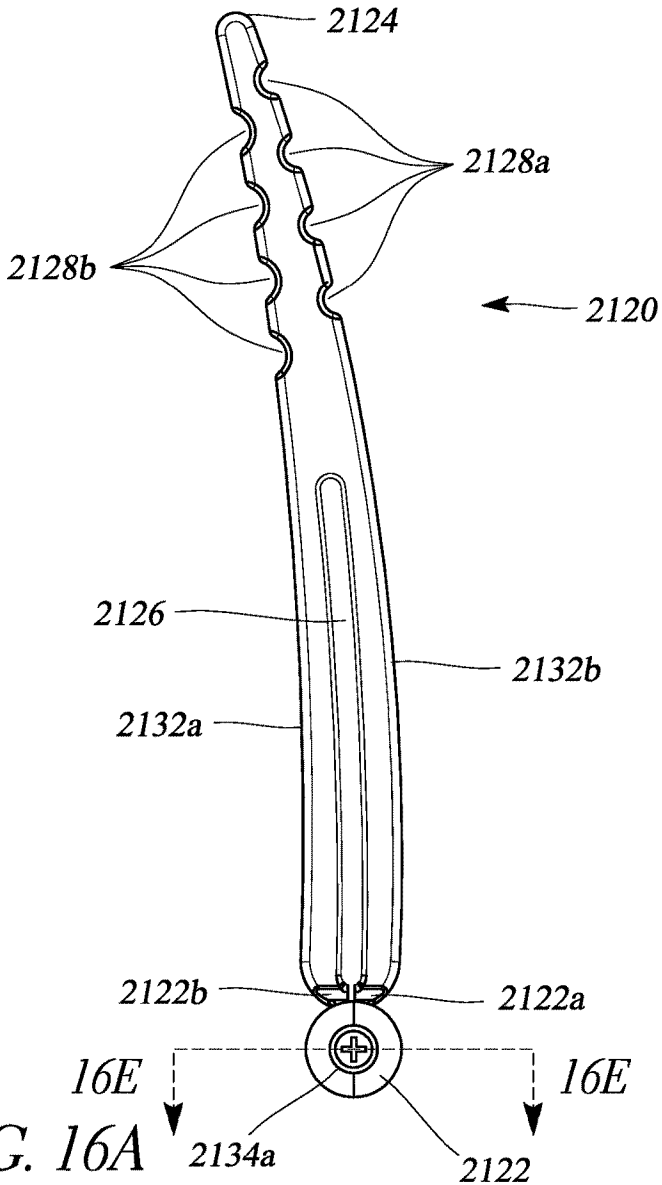
FIG. 16A shows a first side view of a configuration of a pin of the reversible hairclip according to certain aspects of the disclosure.
Figure 16D:
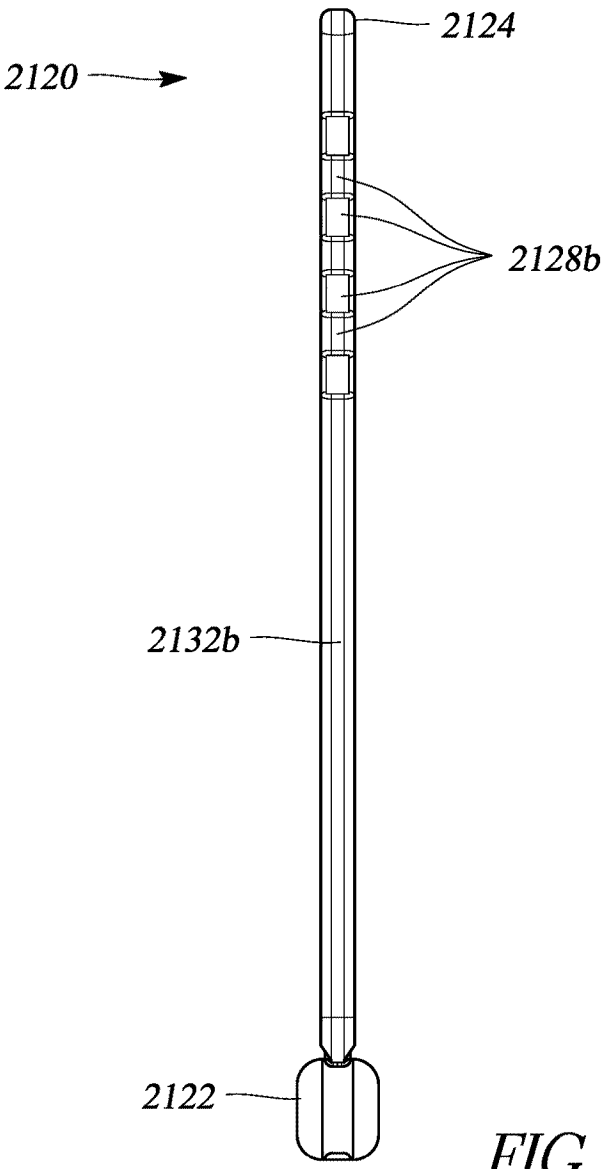
FIG. 16D shows a top view of the configuration of the pin shown in FIG. 16A.
Figure 16C:
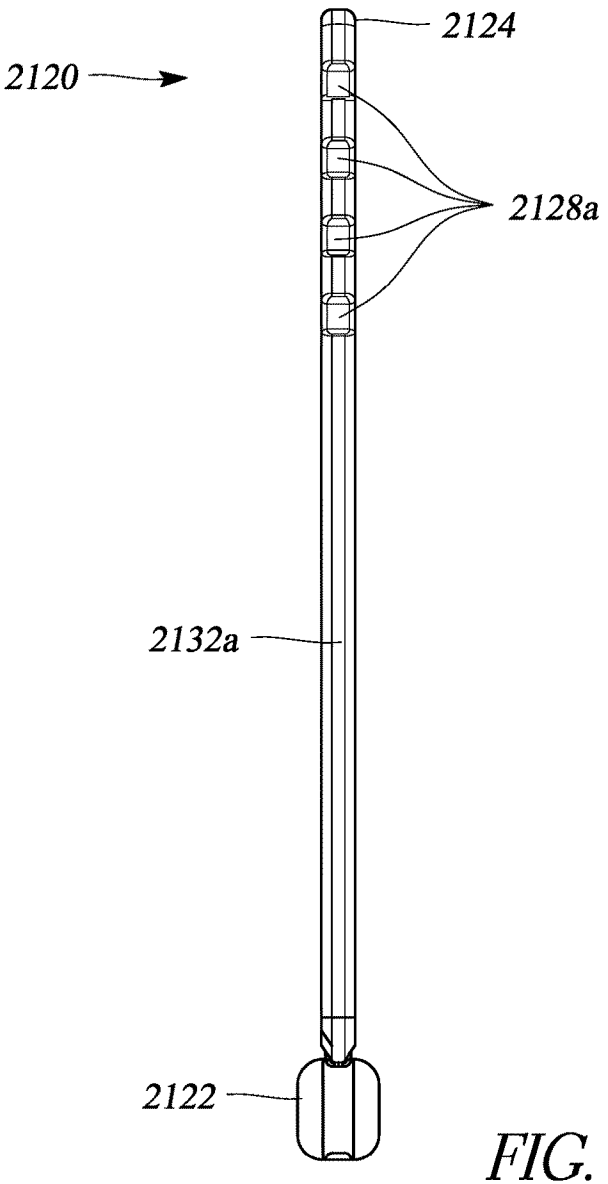
FIG. 16C shows a bottom view of the configuration of the pin shown in FIG. 16A.
Figure 16F:
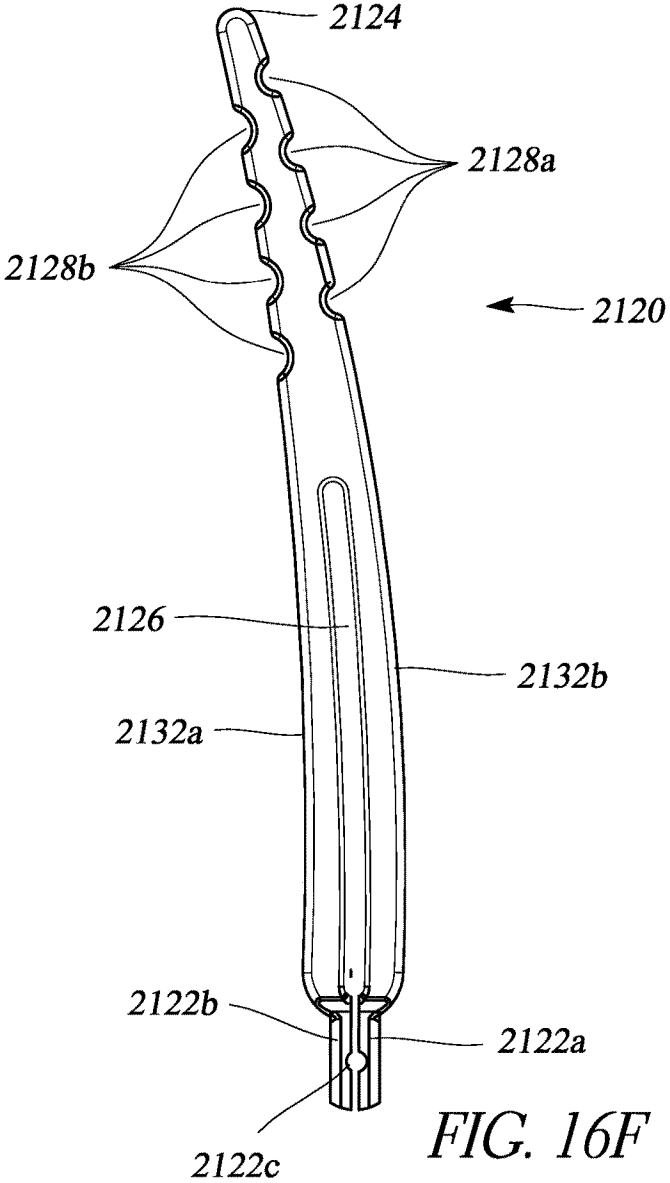
FIG. 16F shows a side view of the pin without the knob shown in FIG. 16A.
Figure 16E:
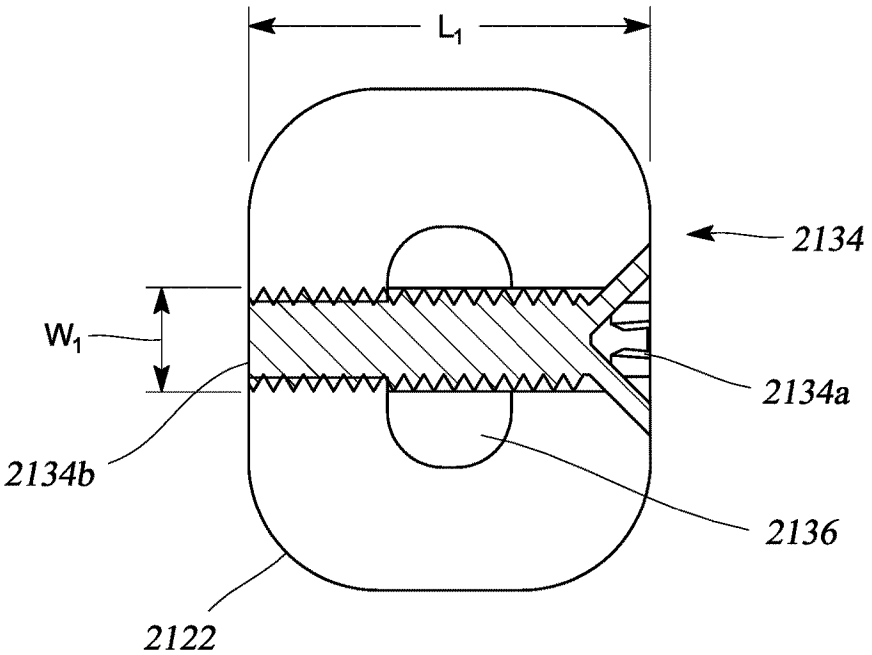
FIG. 16E shows a cross-sectional view of a knob of the pin shown in FIG. 16A.
Figure 16H:
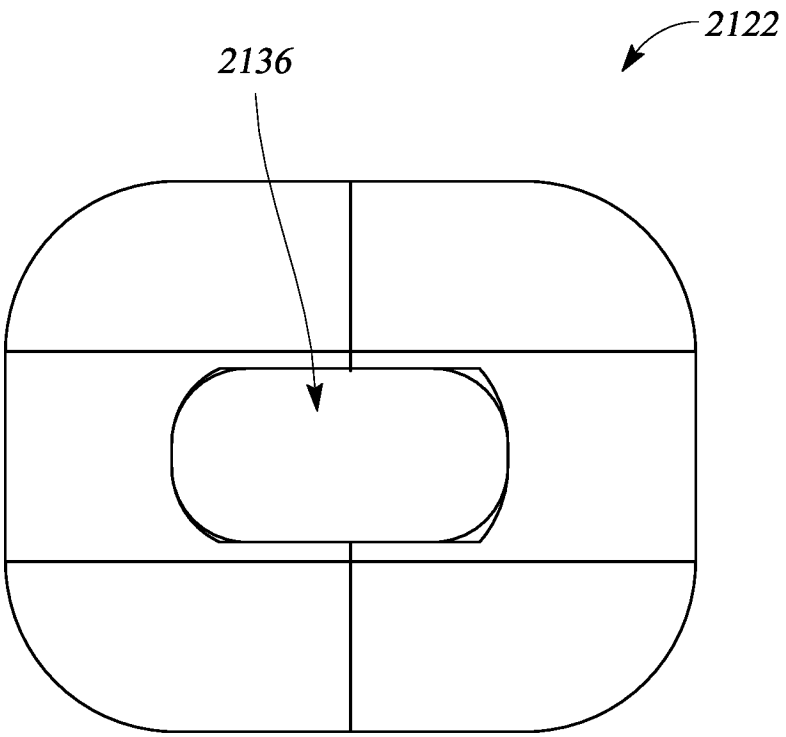
FIG. 16H shows a side view of the knob of the pin shown in FIG. 16A.
Figure 16G:
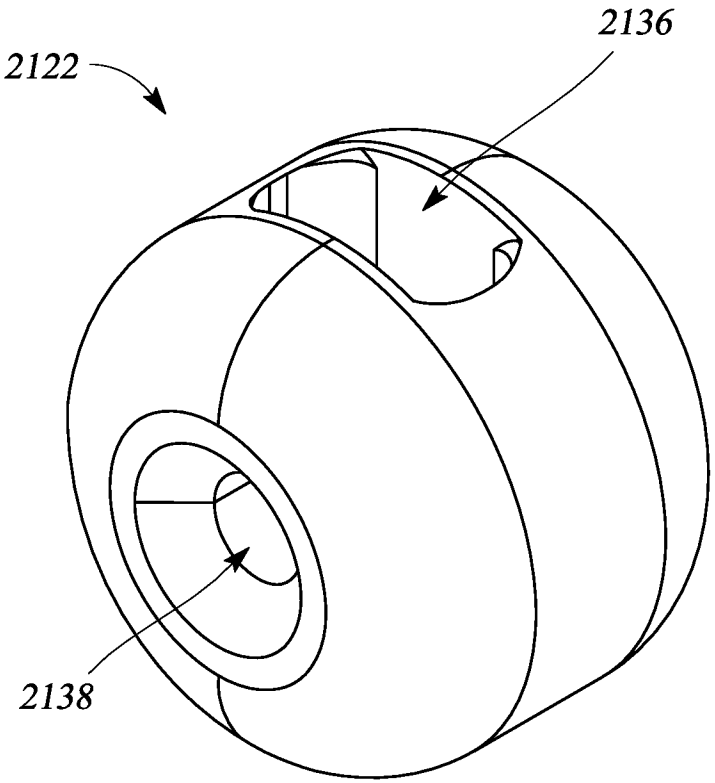
FIG. 16G shows a perspective view of the knob of the pin shown in FIG. 16A.

As shown in FIGS. 16A-16D, the curved pin 2120 can include a knob 2122 configured to receive two prongs 2122*a*, 2122*b* of the curved pin 2120. For example, as shown in FIGS. 16G-16I, the knob 2122 can include a first through-hole 2136 and a second through-hole 2138. In some configurations, the first through-hole 2136 can extend approximately perpendicularly to the second through-hole 2138. The first through-hole 2136 can be configured to receive the two prongs 2122*a*, 2122*b*. As shown in FIG. 16E, the knob 2122 can be secured to the two prongs 2122*a*, 2122*b* via a securement mechanism 2134. For example, the securement mechanism 2134 can be a screw 2134 or a rod. In some configurations, the curved pin 2120 can include an opening 2122*c* formed between the two prongs 2122*a*, 2122*b*. The opening 2122*c* can be configured to align with the second through-hole 2138 when the knob 2122 is secured onto the two prongs 2122*a*, 2122*b*. In some configurations, the securement mechanism 2134 can extend through the second through-hole 2138 and the opening 2122*c* to secure the knob 2122 to the two prongs 2122*a*, 2122*b*.

The curved pin 2120 can be configured to be secured to any of the bands 110, 210, 310, 410, 510, 710, 810, 910, 1010 described herein. For example, the securement mechanism 2134 can be removed from the knob 2122 such that the knob 2122 can be removed from the two prongs 2122*a*, 2122*b*. A first band 110, 210, 310, 410, 510, 710, 810, 910, 1010 can be inserted into the slot 2126 and the knob 2122 can be secured onto the two prongs 2122*a*, 2122*b* to secure the first band 110, 210, 310, 410, 510, 710, 810, 910, 1010 within the slot 2126. If the user wants to wear a different style or a different sized band 110, 210, 310, 410, 510, 710, 810, 910, 1010, the user can remove the knob 2122 and the first band 110, 210, 310, 410, 510, 710, 810, 910, 1010 from the curved pin 2120. The user can then insert the second band 110, 210, 310, 410, 510, 710, 810, 910, 1010 into the slot 2126 and secure it with the knob 2122. Additionally, if the user wants to use the same band 110, 210, 310, 410, 510, 710, 810, 910, 1010 and a different style or a different sized curved pin 2120, the user can exchange the pin 2120 in this same or similar manner.

In some configurations, the curved pin 2120 may rotate about an axis of the band 110, 210, 310, 410, 510, 710, 810, 910, 1010 that runs through the length of the first end of the band 110, 210, 310, 410, 510, 710, 810, 910, 1010. In some configurations, the user can remove the band 110, 210, 310, 410, 510, 710, 810, 910, 1010 from the curved pin 2120, rotate the curved pin 2120, and reinsert the band 110, 210, 310, 410, 510, 710, 810, 910, 1010 into the curved pin 2120. The curved pin's 2120 ability to rotate about the band 110, 210, 310, 410, 510, 710, 810, 910, 1010 and the user's ability to rotate the curved pin 2120 allows the plurality of notches 2128*a*, 2128*b* on both sides of the pin 2120 to be able to engage with the second end of the band 110, 210, 310, 410, 510, 710, 810, 910, 1010. This allows the curved pin 2120 to be able to accommodate different hair thicknesses. For example, when the first longitudinal side 2132*a* is facing toward the band 110, 210, 310, 410, 510, 710, 810, 910, 1010, the hairclip can accommodate thinner hair or less hair. The first longitudinal side 2132*a* can be convex such that there is a smaller opening between the pin 2120 and the band 110, 210, 310, 410, 510, 710, 810, 910, 1010 compared to when the second longitudinal side 2132*b* faces the band 110, 210, 310, 410, 510, 710, 810, 910, 1010 to accommodate thinner hair or less hair. When the second longitudinal side 2132*b* is facing toward the band 110, 210, 310, 410, 510, 710, 810, 910, 1010, the hairclip can accommodate thicker hair or more hair. The second longitudinal side 2132*b* can be concave such that there is a larger opening between the pin 2120 and the band 110, 210, 310, 410, 510, 710, 810, 910, 1010 compared to when the first longitudinal side 2132*a* faces the band 110, 210, 310, 410, 510, 710, 810, 910, 1010 to accommodate thicker hair or more hair As shown in FIG. 16E, the second through-hole 2138 can include a length $L_1$ and a width $W_1$. In some configurations, the length $L_1$ can be between about 5 mm and about 20 mm, about 10 mm and about 15 mm, or about 8 mm. In some configurations, the width $W_1$ can be between about 1 mm and about 10 mm, about 4 mm and about 8 mm, or about 2 mm. In some configurations, the second through-hole 2138 can include different lengths $L_1$ and/or widths $W_1$ for the different sizes of the curved pin 2120.

Figure 16J:
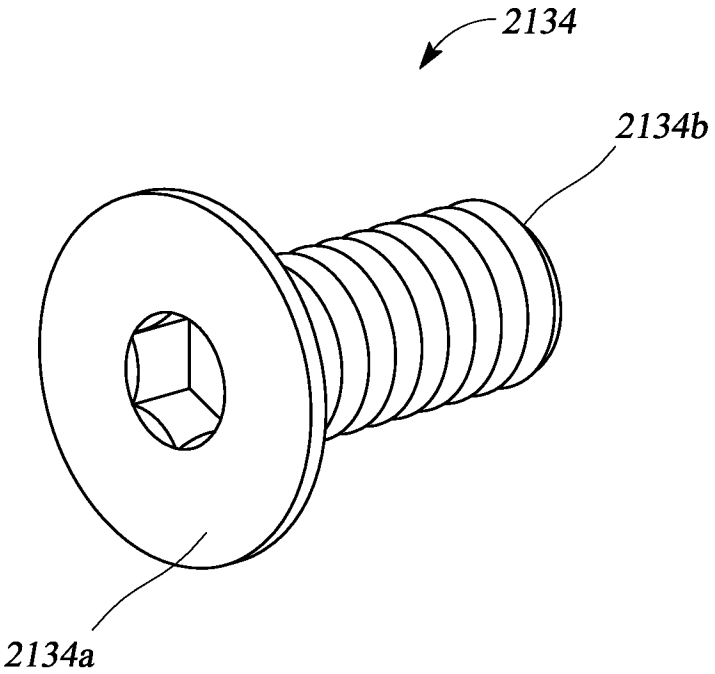
FIG. 16J shows a perspective view of a securement mechanism of the pin shown in FIG. 16A.
Figure 16I:
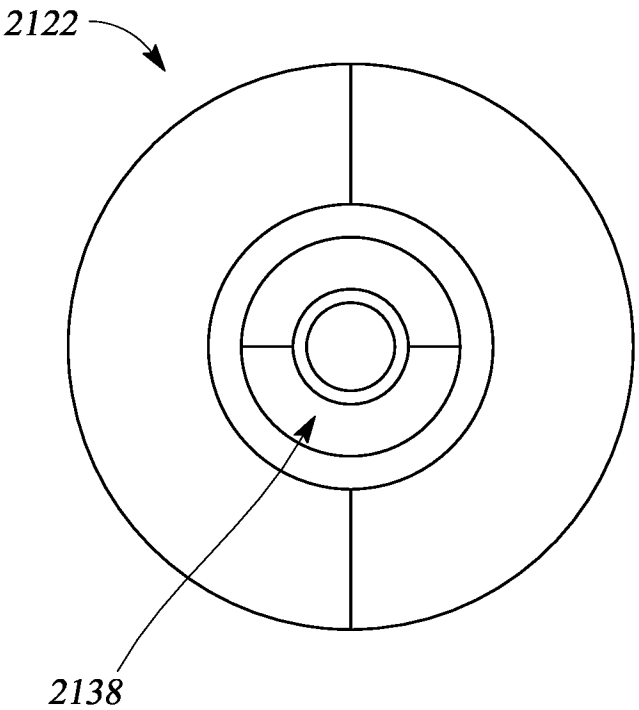
FIG. 16I shows a front view of the knob of the pin shown in FIG. 16A.
Figure 16L:
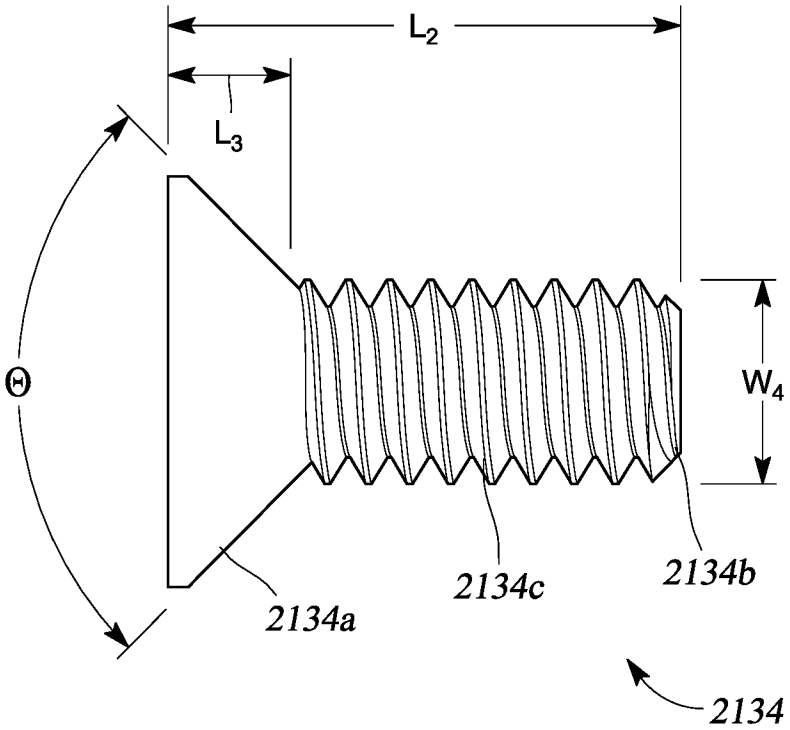
FIG. 16L shows a side view of the securement mechanism shown in FIG. 16J.
Figure 16K:
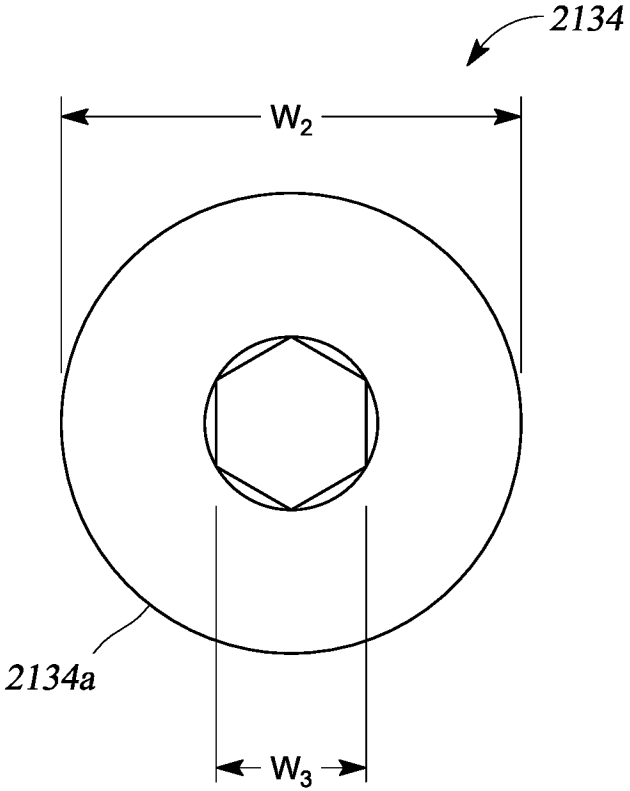
FIG. 16K shows a top view of the securement mechanism shown in FIG. 16J.

FIGS. 16J-16L illustrates an example securement mechanism 2134. The illustrated configuration of the securement mechanism 2134 is a screw 2134. The screw 2134 can have a head end comprising a first or head end 2134*a*, and a threaded portion 2134*b* comprising a second end 2134*b*.

As shown in FIGS. 16K-16L, the screw 2134 can include a length $L_2$, a maximum width $W_2$, and a minimum width $W_4$. In some configurations, the length $L_2$ can be between about 1 mm and about 20 mm, about 5 mm and about 15 mm, or about 5 mm. In some configurations, the maximum width $W_2$ can be between about 1 mm and about 10 mm, about 4 mm and about 8 mm, or about 4 mm. In some configurations, the minimum width $W_4$ can be between about 1 mm and about 10 mm, about 4 mm and about 8 mm, or about 2 mm. In some configurations, the screw 2134 can have different sizes to accommodate the different sizes of the curved pin 2120.

The head end 2134*a* can include an aperture sized and configured to removably receive a tool for securing the screw 2134 to the knob 2122. For example, the tool can be a wrench (e.g., a hex key or hexagon wrench) or a screwdriver. The aperture can include a width $W_3$. In some configurations, the width $W_3$ can be between about 1 mm and about 5 mm, or about 1.3 mm. The head end 2134*a* can include the maximum width $W_2$ of the screw 2134. The head can include sidewalls that taper from the maximum width $W_2$ of the head end 2134*a* to the minimum width $W_4$ of the threaded portion 2134*c* at an angle Θ between the side walls. The angle Θ can be between about 60 degrees and about 120 degrees, or about 90 degrees. The head of the screw 2134 can include a length $L_3$. In some configurations, the length $L_3$ can be between about 0.5 mm and about 5 mm, about 2 mm and about 4 mm, or about 1.2 mm.

Different dimensions, thicknesses, and hardnesses set forth in the present application may be changed and these changes are within the scope of the present invention.

The terms "first" and "second" are merely numbered for describing corresponding technical features clearly and do not represent the actual order. During particular implementations, the locations of the technical features defined by the terms "first" and "second" are interchangeable.

Terms of orientation used herein, such as "top," "bottom," "horizontal," "vertical," "longitudinal," "lateral," "outer," "inner," and "end" are used in the context of the illustrated embodiment. However, the present disclosure should not be limited to the illustrated orientation. Indeed, other orientations are possible and are within the scope of this disclosure. Terms relating to circular shapes as used herein, such as "diameter" or "radius," should be understood not to require perfect circular structures, but rather should be applied to any suitable structure with a cross-sectional region that can be measured from side-to-side. Terms relating to shapes generally, such as "circular" or "cylindrical" or "semi-circular" or "semi cylindrical" or any related or similar terms, are not required to conform strictly to the mathematical definitions of circles or cylinders or other structures, but can encompass structures that are reasonably close approximations.

The terms "approximately," "about" and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Conditional language, such as "can," "could," "might," or "may," unless specifically stated otherwise or otherwise understood within the context as used, is generally intended to convey that certain embodiments include or do not include, certain features, elements and/or steps. Thus, such conditional language is not generally intended to imply that features, elements and/or steps are in any way required for one or more embodiments.

Conjunctive language, such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y and at least one of Z.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed and/or rearranged. Further, the disclosure herein of any particular feature, aspect, method, property, characteristic, quality, attribute, element or the like in connection with various embodiments can be used in all other embodiments set forth herein. Additionally, any methods described herein may be practiced using any device suitable for performing the recited steps.

Although this invention has been disclosed in the context of certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A reversible hairclip comprising:

a flexible inelastic band comprising a first loop comprising a first indented portion at a first end, a second loop comprising a second indented portion at a second end, a middle section between the first and second loops, an interior material having spring-like properties, and an exterior material, wherein the first loop, the second loop, and the middle section are arranged to form a figure eight shape, wherein an outer diameter of the first indented portion and an outer diameter of the second indented portion is smaller than an outer diameter of an adjacent portion of the flexible inelastic band, wherein the first end of the first loop is spaced from the middle section and the second end of the second loop is spaced from the middle section, wherein the exterior material encases the interior material such that the exterior material prevents fluid from contacting the interior material; and a curved pin comprising a first elongate side, a second elongate side, a knob, a tip end opposite the knob, and a slot, wherein the knob comprises a first portion and a second portion that are joined together and the knob is configured to pass through the first loop, wherein the curved pin comprises a length extending from the knob to the tip end, wherein the slot is positioned adjacent the knob and extends along at least a portion of the length of the curved pin toward the tip end, wherein the slot is configured to receive the first indented portion of the flexible inelastic band and the first indented portion of the flexible inelastic band is movable within the slot, wherein the tip end comprises a plurality of notches along the first and second elongate sides and the plurality of notches are configured to engage with the second indented portion of the flexible inelastic band, wherein the curved pin is configured to rotate around an axis of the first indented portion such that the plurality of notches along the first or second elongate side of the tip end of the curved pin can engage with the second indented portion.

2. The reversible hairclip of claim 1, wherein the interior material comprises a metal.

3. The reversible hairclip of claim 1, wherein the exterior material is configured to be waterproof.

4. The reversible hairclip of claim 1, wherein the exterior material comprises a plastic material.

5. The reversible hairclip of claim 4, wherein the plastic material comprises a polypropylene material.

6. The reversible hairclip of claim 1, wherein the exterior material comprises a hardness of approximately Shore 30 A.

7. The reversible hairclip of claim 1, wherein a surface of the exterior material is configured to grip the hair of the user.

8. The reversible hairclip of claim 1, wherein the first portion and the second portion of the knob are sonically welded together during manufacturing.

9. The reversible hairclip of claim 1, wherein the knob of the curved pin comprises a ball or a substantially cylindrical structure.

10. The reversible hairclip of claim 1, wherein the middle section of the flexible inelastic band comprises a circular structure.

11. The reversible hairclip of claim 1, wherein the slot of the curved pin extends substantially halfway along the length of the curved pin.

12. The reversible hairclip of claim 1, wherein the plurality of notches is configured to engage with the second indented portion such that the hair of the user is secured between the curved pin and the flexible inelastic band in use.

13. A reversible hairclip comprising:

a flexible inelastic band comprising a first loop comprising a first end, a second loop comprising a second end, a clamp between the first and second loops, an interior material having spring-like properties, and an exterior material, wherein the first loop, the second loop, and the clamp are arranged to form a figure eight shape, wherein the first end of the first loop is spaced from the clamp and the second end of the second loop is spaced from the clamp, wherein the exterior material encases the interior material; and a curved pin comprising a first elongate side, a second elongate side, a knob, a tip end opposite the knob, and a slot, wherein the knob is configured to pass through the first loop, wherein the curved pin comprises a length extending from the knob to the tip end, wherein the slot is positioned adjacent the knob and extends along at least a portion of the length of the curved pin toward the tip end, wherein the slot is configured to receive the first end of the flexible inelastic band and the first end of the flexible inelastic band is movable along the length of the slot, wherein the tip end comprises at least one notch along the first and second elongate sides and the at least one notch is configured to engage with the second end of the flexible inelastic band, wherein the curved pin is configured to rotate around an axis of the first end of the flexible inelastic band such that the at least one notch along the first or second elongate side of the tip end of the curved pin can engage with the second end of the flexible inelastic band.

14. A reversible hairclip comprising:

a flexible inelastic band; and a curved pin configured to be removable from the flexible inelastic band, the curved pin comprising a body portion comprising a tip end opposite a connecting end, a knob configured to be removable from the connecting end of the body portion, and a slot, wherein the connecting end comprises one or more prongs configured to be received by the knob, and wherein the knob comprises one or more holes, wherein the slot is positioned adjacent the knob and extends along at least a portion of the body portion toward the tip end, wherein the slot is configured to receive a first end of the flexible inelastic band and the first end of the flexible inelastic band is movable along a length of the slot, wherein the tip end comprises at least one notch configured to engage with a second end of the flexible inelastic band, wherein the curved pin is configured to rotate around an axis of the first end of the flexible inelastic band such that the at least one notch along the tip end of the curved pin can engage with the second end of the flexible inelastic band.

15. The reversible hairclip of claim 14, wherein the one or more holes comprise a first hole and a second hole, wherein the first hole extends along a length of the knob, wherein the second hole extends substantially perpendicularly to the first hole.

16. The reversible hairclip of claim 15, wherein the first hole is configured to receive the one or more prongs of the body portion.

17. The reversible hairclip of claim 15, wherein the second hole is configured to receive a securement mechanism configured to secure the knob to the connecting end of the body portion.

18. The reversible hairclip of claim 17, wherein the one or more prongs comprises two prongs, wherein the connecting end comprises an opening positioned between the two prongs, and wherein the opening is configured to receive the securement mechanism.

* * * * *